US011402190B2

(12) United States Patent
Sullivan et al.

(10) Patent No.: US 11,402,190 B2
(45) **Date of Patent: *Aug. 2, 2022**

(54) DETONATION SYSTEM HAVING SEALED EXPLOSIVE INITIATION ASSEMBLY

(71) Applicant: XConnect, LLC, Denver, CO (US)

(72) Inventors: Shelby L. Sullivan, Minot, ND (US); Aaron Holmberg, Omaha, NE (US); Nicholas N. Kleinschmit, Omaha, NV (US)

(73) Assignee: XConnect, LLC, Denver, CO (US)

( * ) Notice: Subject to any disclaimer, the term of this patent is extended or adjusted under 35 U.S.C. 154(b) by 191 days.

This patent is subject to a terminal disclaimer.

(21) Appl. No.: 16/996,692

(22) Filed: Aug. 18, 2020

(65) Prior Publication Data

US 2021/0055092 A1 Feb. 25, 2021

Related U.S. Application Data

(63) Continuation-in-part of application No. 16/894,512, filed on Jun. 5, 2020, now Pat. No. 11,255,650, and (Continued)

(51) Int. Cl.
*F42D 1/055* (2006.01)
*E21B 43/1185* (2006.01)
(Continued)

(52) U.S. Cl.
CPC ..... *F42D 1/055* (2013.01); *E21B 43/1185* (2013.01); *F42D 1/02* (2013.01); *E21B 43/117* (2013.01)

(58) Field of Classification Search
USPC ..... 89/1.51
See application file for complete search history.

(56) References Cited

U.S. PATENT DOCUMENTS 2,029,490 A 2/1936 Lane
2,062,974 A 12/1936 Lane
(Continued)

OTHER PUBLICATIONS

GEODynamics' EPIC™ Switches Brochure; GEODynamics; Copyright 2020; v.03; 1 page.

(Continued)

*Primary Examiner* — Reginald S Tillman, Jr.
(74) *Attorney, Agent, or Firm* — Peter L Brewer; Thrive IP

(57) ABSTRACT

A detonation system for a perforating gun assembly. The detonation system includes a tandem sub having a first end and a second opposing end. Each of the first and second ends is connected to a respective perforating gun. The tandem sub has an inner bore, and a switch housing residing within the inner bore. The tandem sub also has an addressable switch residing within the switch housing with the switch being configured to receive instruction signals from a surface by means of an electric line. The addressable switch is in communication with a signal transmission pin and a detonator pin. The detonator pin sends a detonation signal from the addressable switch to a detonator in an adjacent perforating gun. The wiring connections for the pins may be pre-assembled before the perforating guns are delivered to the field. The detonation system utilizes a carrier end plate, wherein the end plate and pins seal off the tandem sub from wellbore fluids and debris following detonation of explosive charges in an associated perforating gun.

24 Claims, 20 Drawing Sheets

Related U.S. Application Data a continuation-in-part of application No. 16/836,193, filed on Mar. 31, 2020, now Pat. No. 10,914,145.

(60) Provisional application No. 63/048,212, filed on Jul. 6, 2020, provisional application No. 62/987,743, filed on Mar. 10, 2020, provisional application No. 62/890,242, filed on Aug. 22, 2019.

(51) Int. Cl.
*F42D 1/02* (2006.01)
*E21B 43/117* (2006.01)

(56) References Cited

U.S. PATENT DOCUMENTS

| | | | |
|---|---|---|---|
| 2,264,450 | A | 12/1941 | Mounce |
| 2,331,058 | A | 10/1943 | Stick, Jr. |
| 2,621,732 | A | 12/1952 | Ahlgren |
| 3,032,107 | A | 5/1962 | Rumble et al. |
| 3,126,964 | A | 3/1964 | La Rue |
| 3,528,511 | A | 9/1970 | Boop et al. |
| 3,648,785 | A | 3/1972 | Walker |
| 3,695,368 | A | 10/1972 | Lanmon, II |
| 3,945,322 | A | 3/1976 | Carlson et al. |
| 4,164,886 | A | 8/1979 | Hallmark |
| 4,759,291 | A | 7/1988 | Barker et al. |
| 5,042,594 | A | 8/1991 | Gonzalez et al. |
| 7,591,212 | B2 | 9/2009 | Myers, Jr. et al. |
| 7,902,469 | B2 | 3/2011 | Hurst |
| 8,074,737 | B2 | 12/2011 | Hill et al. |
| 8,256,337 | B2 | 9/2012 | Hill et al. |
| 8,395,878 | B2 | 3/2013 | Stewart et al. |
| 8,875,787 | B2 | 11/2014 | Tassaroli |
| 9,080,433 | B2 | 7/2015 | Lanclos et al. |
| 9,145,764 | B2 | 9/2015 | Burton et al. |
| 9,581,422 | B2 | 2/2017 | Preiss et al. |
| 9,845,666 | B2 | 12/2017 | Hardesty et al. |
| 10,066,921 | B2 | 9/2018 | Eitschberger |
| 10,184,331 | B2 | 1/2019 | Mace et al. |
| 10,188,990 | B2 | 1/2019 | Burmeister et al. |
| 10,273,788 | B2 | 4/2019 | Bradley et al. |
| 10,352,136 | B2 | 7/2019 | Goyeneche |
| 10,352,674 | B2 | 7/2019 | Eitschberger |
| 10,365,078 | B2 | 7/2019 | Eitschberger |
| 10,458,213 | B1 | 10/2019 | Eitschberger et al. |
| 10,465,462 | B2 | 11/2019 | Frazier et al. |
| 10,472,938 | B2 | 11/2019 | Parks et al. |
| 10,502,036 | B2 | 12/2019 | Spring |
| 10,507,433 | B2 | 12/2019 | Eitschberger et al. |
| 10,519,733 | B2 | 12/2019 | Rosenthal et al. |
| 10,519,754 | B2 | 12/2019 | Prisbell et al. |
| 10,584,950 | B2 | 3/2020 | Saltarelli et al. |
| 10,641,068 | B2 | 5/2020 | Hardesty et al. |
| 10,662,750 | B2 | 5/2020 | Angman et al. |
| 10,669,821 | B2 | 6/2020 | Knight et al. |
| 10,677,026 | B2 | 6/2020 | Hunting |
| 10,689,955 | B1 | 6/2020 | Mauldin et al. |
| 10,731,444 | B2 | 8/2020 | Wells et al. |
| 10,731,445 | B2 | 8/2020 | Akkerman et al. |
| 10,731,955 | B2 | 8/2020 | Baum |
| 10,844,697 | B2 | 11/2020 | Preiss et al. |
| 10,900,334 | B2 | 1/2021 | Knight et al. |
| 10,900,335 | B2 | 1/2021 | Knight et al. |
| 2011/0271823 | A1 | 11/2011 | Vicente |
| 2012/0199352 | A1 | 8/2012 | Lanclos et al. |
| 2012/0247769 | A1 | 10/2012 | Schacherer et al. |
| 2013/0126237 | A1 | 5/2013 | Burton et al. |
| 2014/0338552 | A1 | 11/2014 | Mace et al. |
| 2015/0000509 | A1 | 1/2015 | Current et al. |
| 2018/0135389 | A1 | 5/2018 | Sullivan |

OTHER PUBLICATIONS

Josh Howk and Adam Dyess; "Mitigating the Problems in Select-Fire Perforating Operations" IPS 16-22; 2016 International Perforating Symposium Galveston; May 10, 2016; 15 pages.

Hunting Titan Brochure; Hunting Energy Services; Copyright 2020; v.9.1; 27 pages.

Screen shot of OsoLite® Lite'n Your Workload with Oso's Prewired, Disposable Perforating Gun System; https://www.osoperf.com/perf-hardware/osolite; Date of access of Feb. 1, 2021; 2 pages.

Screen shot of SWM International Inc. Thunder Disposable Gun System; https://web.archive.org/web/20200109183633/http:/swmtx.com/pdf/thunder_gun.pdf; Date of access of Feb. 1, 2021; 5 pages.

Screen shot of Yellow Jacket Oil Tools: Perforating Guns; https://www.yjoiltools.com/perforating-guns; Date of access of Feb. 1, 2021; 1 page.

Screen shot of Nexus Perforating: Double Nexus Connect (Thunder Gun System); https://www.yjoiltools.com/perforating-guns; Date of access of Feb. 1, 2021; 1 page.

Screen shot of VIGOR USA: Perforating Gun Accessories—Economical and Dependable Perforating Gun Accessories https://vigorusa.com/perforating-gun-accessories/; Date of access of Feb. 1, 2021; 2 page.

Screen shot of Yellow Jacket Oil Tools: Pre-Wired Perforating Gun; https://www.yjoiltools.com/Perforating-Guns/Pre-Wired-Perforating-Gun; Date of access of Feb. 1, 2021; 1 page.

Screen shot of GR Energy Services—ZipFire™ ReFrac gun system; https://www.grenergyservices.com/zipfire-refrac/; Date of access of Feb. 1, 2021; 2 pages.

Screen shot of GR Energy Services—ZipFire™ high-efficiency perforating system answers current completion demands for higher stage-per-day performance; https://www.grenergyservices.com/zipfire/; date of access of Feb. 1, 2021; 2 pages.

Screen shot of Rock Faithwell—Perforating Gun System; http://www.cnrock.com.cn/h-col-116.html; date of access of Feb. 1, 2021; 2 pages.

Screen shot of APT American—Perforating Guns; https://aptamerican.com/perforating-guns; date of access of Feb. 1, 2021; 1 page.

Screen shot of NexTier—Innovative Solutions: GameChanger™ Perforating System; https://nextierofs.com/solutions/innovative-solutions/gamechanger/; date of access of Feb. 1, 2021; 2 pages.

DETONATION SYSTEM HAVING SEALED EXPLOSIVE INITIATION ASSEMBLY

STATEMENT OF RELATED APPLICATIONS

The present application claims the benefit of U.S. Ser. No. 63/048,212 filed Jul. 6, 2020. That application is entitled "Detonation System Having Sealed Explosive Initiation Assembly."

The present application further claims the benefit of U.S. Ser. No. 62/890,242 filed Aug. 22, 2019. That application is entitled "Explosive Initiation Assembly For a Tandem Sub."

This application further claims the benefit of U.S. Ser. No. 62/987,743 filed Mar. 10, 2020. That application is entitled "Detonation System Having Sealed Explosive Initiation Assembly."

The present application is also filed as a Continuation-In-Part of U.S. Ser. No. 16/838,193 filed Mar. 31, 2020. That application is entitled "A Bulkhead Assembly for a Tandem Sub, and an Improved Tandem Sub."

Additionally, the present application is filed as a Continuation-In-Part of U.S. Ser. No. 16/894,512 filed Jun. 6, 2020. That application is entitled "Detonation System Having Sealed Explosive Initiation Assembly."

Each of these applications is incorporated herein in its entirety by reference.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Technical Field of the Invention

The present disclosure relates to the field of hydrocarbon recovery operations. More specifically, the invention relates to a tandem sub used to mechanically and electrically connect detonation tools in a perforating gun assembly. Further still, the invention relates to an assembly residing within a tandem sub for initiating an explosive charge for a perforating gun, and further, to a detonation assembly that protects the electronics located inside of the tandem sub from wellbore fluid and debris produced by the detonation of charges from an associated perforating gun.

Discussion of the Background

In the drilling of an oil and gas well, a near-vertical wellbore is formed through the earth using a drill bit urged downwardly at a lower end of a drill string. After drilling to a predetermined depth, the drill string and bit are removed and the wellbore is lined with a string of casing. An annular area is thus formed between the string of casing and the formation penetrated by the wellbore.

A cementing operation is conducted in order to fill or "squeeze" the annular volume with cement along part or all of the length of the wellbore. The combination of cement and casing strengthens the wellbore and facilitates the zonal isolation, and subsequent completion, of hydrocarbon-producing pay zones behind the casing.

In connection with the completion of the wellbore, several strings of casing having progressively smaller outer diameters will be cemented into the wellbore. These will include a string of surface casing, one or more strings of intermediate casing, and finally a production casing. The process of drilling and then cementing progressively smaller strings of casing is repeated until the well has reached total depth. In some instances, the final string of casing is a liner, that is, a string of casing that is not tied back to the surface.

Within the last two decades, advances in drilling technology have enabled oil and gas operators to "kick-off" and steer wellbore trajectories from a vertical orientation to a horizontal orientation. The horizontal "leg" of each of these wellbores now often exceeds a length of one mile, and sometimes two or even three miles. This significantly multiplies the wellbore exposure to a target hydrocarbon-bearing formation. The horizontal leg will typically include the production casing.

FIG. 1 is a side, cross-sectional view of a wellbore 100, in one embodiment. The wellbore 100 has been completed horizontally, that is, it has a horizontal leg 156. The wellbore 100 defines a bore 10 that has been drilled from an earth surface 105 into a subsurface 110. The wellbore 100 is formed using any known drilling mechanism, but preferably using a land-based rig or an offshore drilling rig operating on a platform.

The wellbore 100 is completed with a first string of casing 120, sometimes referred to as surface casing. The wellbore 100 is further completed with a second string of casing 130, typically referred to as an intermediate casing. In deeper wells, that is, wells completed below 7,500 feet, at least two intermediate strings of casing will be used. In FIG. 1, a second intermediate string of casing is shown at 140.

The wellbore 100 is finally completed with a string of production casing 150. In the view of FIG. 1, the production casing 150 extends from the surface 105 down to a subsurface formation, or "pay zone" 115. The wellbore 100 is completed horizontally, meaning that a horizontal "leg" 156 is provided. The production casing 150 extends across the horizontal leg 156.

It is observed that the annular region around the surface casing 120 is filled with cement 125. The cement (or cement matrix) 125 serves to isolate the wellbore 100 from fresh water zones and potentially porous formations around the casing string 120.

The annular regions around the intermediate casing strings 130, 140 are also filled with cement 135, 145. Similarly, the annular region around the production casing 150 is filled with cement 155. However, the cement 135, 145, 155 is optionally only placed behind the respective casing strings 130, 140, 150 up to the lowest joint of the immediately surrounding casing string. Thus, a non-cemented annular area 132 is typically preserved above the cement matrix 135, a non-cemented annular area 142 may optionally be preserved above the cement matrix 135, and a non-cemented annular area 152 is frequently preserved above the cement matrix 155.

The horizontal leg 156 of the wellbore 100 includes a heel 153 and a toe 154. In this instance, the toe 154 defines the end (or "TD") of the wellbore 100. In order to enhance the recovery of hydrocarbons, particularly in low-permeability formations 115, the casing 150 along the horizontal section 156 undergoes a process of perforating and fracturing (or in some cases perforating and acidizing). Due to the very long lengths of new horizontal wells, the perforating and formation treatment process is typically carried out in stages.

In one method, a perforating gun assembly 200 is pumped down towards the end of the horizontal leg 156 at the end of a wireline 240. The perforating gun assembly 200 will include a series of perforating guns (shown at 210 in FIG. 2), with each gun having sets of charges ready for detonation. The charges associated with one of the perforating guns are detonated and perforations (not shown) are "shot" into the casing 150. Those of ordinary skill in the art will understand that a perforating gun has explosive charges, typically shaped, hollow or projectile charges, which are ignited to create holes in the casing (and, if present, the surrounding cement) 150 and to pass at least a few inches and possibly several feet into the formation 115. The perforations create fluid communication with the surrounding formation 115 so that hydrocarbon fluids can flow into the casing 150.

After perforating, the operator will fracture (or otherwise stimulate) the formation 115 through the perforations (not shown). This is done by pumping treatment fluids into the formation 115 at a pressure above a formation parting pressure. After the fracturing operation is complete, the wireline 240 will be raised and the perforating gun assembly 200 will be positioned at a new location (or "depth") along the horizontal wellbore 156. A plug (such as plug 112) is set below the perforating gun assembly 200 using a setting tool 160, and new shots are fired in order to create a new set of perforations. Thereafter, treatment fluid is again pumping into the wellbore 100 and into the formation 115 at a pressure above the formation parting pressure. In this way, a second set (or "cluster") of fractures is formed away from the wellbore 156.

The process of setting a plug, perforating the casing, and fracturing the formation is repeated in multiple stages until the wellbore has been completed, that is, it is ready for production. A string of production tubing (not shown) is then placed in the wellbore to provide a conduit for production fluids to flow up to the surface 105.

In order to provide perforations for the multiple stages without having to pull the perforating gun 200 after every detonation, the perforating gun assembly 200 employs multiple guns in series. FIG. 2 is a side view of an illustrative perforating gun assembly 200, or at least a portion of an assembly. The perforating gun assembly 200 comprises a string of individual perforating guns 210.

Each perforating gun 210 represents various components. These typically include a "gun barrel" 212 which serves as an outer tubular housing. An uppermost gun barrel 212 is supported by an electric wire (or "e-line") 240 that extends from the surface 105 and delivers electrical energy down to the tool string 200. Each perforating gun 210 also includes an explosive initiator, or "detonator" (shown at 594 in FIG. 25C). The detonator is typically a small aluminum housing having a resistor inside. The detonator receives electrical energy from the surface 105 and through the e-line 240, which heats the resistor.

The detonator is surrounded by a sensitive explosive material. When current is run through the detonator, a small explosion is set off by the electrically heated resistor. This small explosion sets off an adjacent detonating cord (shown at 595 in FIG. 25C).

The detonating cord contains an explosive compound that is detonated by the detonator. The detonating cord initiates one or more shots, typically referred to as "shaped charges." The shaped charges (shown at 520 in FIG. 5) are held in an inner tube (shown at 500 in FIG. 5), referred to as a carrier tube, for security and discharge through openings 215 in the selected gun barrel 212. The detonating cord propagates an explosion down its length to each of the shaped charges along the carrier tube.

The perforating gun assembly 200 may include short centralizer subs 220. In addition, tandem subs 225 are used to connect the gun barrel housings 212 end-to-end. Each tandem sub 225 comprises a metal threaded connector placed between the gun barrels 210. Typically, the gun barrels 210 will have female-by-female threaded ends while the tandem sub 225 has opposing male threaded ends.

The perforating gun assembly 200 with its long string of gun barrels (the housings 212 of the perforating guns 210) is carefully assembled at the surface 105, and then lowered into the wellbore 10 at the end of the e-line 240. The e-line 240 extends upward to a control interface (not shown) located at the surface 105. An insulated connection member 230 connects the e-line 240 to the uppermost perforating gun 210. Once the assembly 200 is in place within a wellbore, an operator of the control interface sends electrical signals to the perforating gun assembly 200 for detonating the shaped charges 520 and for creating perforations into the casing 150.

After the casing 150 has been perforated and at least one plug 112 has been set, the setting tool 120 and the perforating gun assembly 200 are taken out of the wellbore 100 and a ball (not shown) is dropped into the wellbore 100 to close the plug 112. When the plug 112 is closed, a fluid (e.g., water, water and sand, fracturing fluid, etc.) is pumped by a pumping system down the wellbore (typically through coiled tubing) for fracturing purposes.

As noted, the above operations may be repeated multiple times for perforating and/or fracturing the casing 150 at multiple locations, corresponding to different stages of the well. Multiple plugs may be used for isolating the respective stages from each other during the perforating phase and/or fracturing phase. When all stages are completed, the plugs are drilled out and the wellbore 100 is cleaned using a circulating tool.

It can be appreciated that a reliable electrical connection must be made between the gun barrels 210 in the tool string 200 through each tandem sub 225. Currently, electrical connections are primarily made using a side entrance port on the tandem sub 225 to manually connect wires. When the charges are fired, the electronics in each carrier tube are lost and the tandem subs are frequently sacrificed.

A need exists for a detonation system wherein the electronic switch is housed within the tandem sub such that the wiring connections may be pre-assembled before the perforating guns are delivered to the field. A need further exists for a detonation system utilizing a tandem sub having a carrier end plate, wherein the end plate seals off the tandem sub from wellbore fluids and debris following detonation of explosive charges in an associated perforating gun. Additionally, a need exists for a detonation system that uses signal transmission pins that extend through an end plate in order to deliver detonation signals, while mechanically and fluidically sealing off an associated tandem sub from wellbore fluids and debris following detonation of explosive charges.

SUMMARY OF THE INVENTION

A detonation system for a perforating gun assembly is provided. The detonation system utilizes an addressable switch that transmits a detonation signal to a detonator in an adjacent perforating gun. The detonator, in turn, ignites an explosive material, creating an explosion that is passed through a detonating cord. The detonating cord then ignites shaped charges along the perforating gun.

The detonation system first includes a tandem sub. The tandem sub defines a short tubular body having a first end and a second opposing end. A circular shoulder may be provided intermediate the first and second ends. The first and second ends comprise male threads that are configured to connect to gun barrels of adjacent perforating guns. The gun barrels are threaded onto the opposing ends of the tandem sub until they reach the intermediate shoulder.

The detonation system also includes a perforating gun. The perforating gun comprises a carrier tube, a plurality of charges residing within the carrier tube, and a gun barrel. The gun barrel serves as a housing for the carrier tube and the plurality of charges. In one aspect, the gun barrel has female threads that connect to male threads at a first end of the tandem sub.

The detonation system additionally includes a switch housing. The switch housing resides within an inner bore of the tandem sub, proximate the first end.

As noted, the detonation system also includes the addressable switch. The addressable switch resides entirely within the switch housing. The addressable switch is configured to receive instruction signals from the surface by means of a signal line. The addressable switch listens for a detonation signal that is associated with that tandem sub.

The detonation system also comprises a bottom end plate. The bottom end plate resides between the carrier tube of the perforating gun and the first end of the tandem sub. The bottom end plate has a first through-opening.

The detonation system additionally comprises a detonator pin. The detonator pin extends through the first through-opening of the bottom end plate. The detonator pin has a proximal end that extends into the carrier tube and that is in electrical communication with a detonator. The detonator pin further has a distal end that extends into the switch housing and is in electrical communication with the addressable switch. The detonator pin is preferably fabricated from an electrically conductive material.

Beneficially, the bottom end plate provides a seal against the first end of the tandem sub to protect the addressable switch from a pressure wave generated by detonation of the plurality of charges in the adjacent carrier tube. Preferably, the carrier tube is upstream from the tandem sub, which means that the bottom end plate is actually above, or upstream from, the tandem sub.

In one aspect, the detonation system further comprises a bulkhead for the detonation pin. The bulkhead resides around an intermediate portion of the detonation pin such that the bulkhead frictionally resides within the through-opening of the bottom end plate. Preferably, the bulkhead for the detonation pin is fabricated from a non-conductive material.

In one aspect, the detonation system further comprises a contact pin. The contact pin is also fabricated from a conductive material and also resides within the inner bore of the tandem sub. The contact pin comprises a contact head that extends into the switch housing from the bottom, a shaft, and a distal end in electrical communication with the signal line. The contact pin is configured to transmit instruction signals from the surface to a next (or downstream) perforating gun by means of the signal line.

Preferably, the detonation system also has a top end plate. The top end plate resides at the second end of the tandem sub, between the tandem sub and a next perforating gun. The top end plate receives the distal end of the contact pin. Note that the top end plate is preferably above a downstream carrier tube associated with the next perforating gun, which means that the top end plate is actually below, or downstream from, the tandem sub.

The detonation system also has a transmission pin. The transmission pin resides within a second through-opening of the bottom end plate, and delivers detonation signals from the electric line to the addressable switch.

Finally, the detonation system comprises a ground post. The ground post has a proximal end extending into the switch housing, and a distal end threaded onto the bottom end plate.

In the detonation system, the addressable switch is configured to monitor instruction signals received through the signal line and transmission pin. When an instruction signal is received to detonate charges in the adjacent carrier tube, that is, the gun barrel, the addressable switch sends a detonation signal through the detonation pin and to the detonator. Preferably, the perforating gun having the adjacent carrier tube is upstream of the tandem sub. However, in the detonation system the gun barrel may be downstream of the tandem sub.

In operation, the detonation system is part of the perforating gun assembly. The perforating gun assembly is run into a wellbore at the end of an electric line. More typically, the perforating gun assembly is pumped into the horizontal portion of the wellbore. The ground post and the contact pin are in electrical communication with the e-line, with the e-line extending from the perforating gun assembly up to the surface. When a signal is sent through the e-line, it is carried through the perforating gun assembly by means of the signal line and the contact pins residing within the string of perforating guns and tandem subs.

The addressable switches filter instruction signals from the operator at the surface. When an addressable switch receives a signal associated with its tandem sub and perforating gun, the addressable switch will send a detonation signal through the detonation pin and to the detonator. The detonator, in turn, ignites the explosive material that passes through the detonating cord and on to the charges along the carrier tube.

In addition to the detonation system, a tandem sub for a perforating gun assembly is also provided herein. The tandem sub comprises a first end and an opposing second end. The first end represents a male connector and is threadedly connected to a first perforating gun. Similarly, the second end represents a male connector and is threadedly connected to a second perforating gun.

The first end abuts a first end plate while the second end abuts a second end plate. An inner bore extends between the first end of the tandem sub and the second end.

A switch housing resides within the inner bore of the tandem sub proximate the first end. An addressable switch resides within the switch housing. The addressable switch is configured to receive instruction signals from an operator at the surface via a signal line.

The tandem sub includes a detonation pin and a separate signal transmission pin. The detonation pin has a proximal end that extends into an adjacent carrier tube and is in electrical communication with a detonator. The detonation pin also has a distal end that extends into the switch housing and is in electrical communication with the addressable switch. Similarly, the transmission pin has a proximal end that extends into the switch housing, and a distal end that is in electrical communication with a signal line coming in from the carrier tube.

The tandem sub includes a receptacle. The receptacle is positioned within the inner bore of the tandem sub proximate the second end. The receptacle is dimensioned to closely receive a bulkhead, wherein the bulkhead comprises:

- a tubular body having a first end, a second end and a bore extending there between;
- an electrical contact pin having a shaft extending through the bore of the bulkhead body and having a first end and a second end, wherein the shaft frictionally resides within the bore, and wherein the electrical contact pin transmits current from the first end to the second end; and
- a contact head located at the second end of the electrical contact pin outside of the bulkhead body and extending into the switch housing.

The contact pin is fabricated substantially from a conductive material. The contact head transmits instruction signals from the electric line (such as by means of a ground post) to a next perforating gun.

In one aspect, the first end plate comprises a first through-opening and a second through-opening. The first through-opening receives the detonation pin while the second through-opening receives the signal transmission pin. The signal transmission pin and the contact pin are in electrical communication with the e-line, with the e-line extending from the perforating gun assembly up to the surface.

The addressable switch filters instruction signals from the operator at the surface. When the addressable switch receives a signal associated with its tandem sub and adjacent perforating gun, the addressable switch will send a detonation signal through the detonation pin and back up to the detonator. As noted above, the detonator defines a small aluminum housing having a resistor inside. The resister is surrounded by a sensitive explosive material. When current is run through the detonator, a small explosion is set off by the electrically heated resistor. This small explosion ignites an explosive material placed within the detonating cord. As the explosive material is ignited, the detonating cord delivers the explosion to shaped charges along the first perforating gun.

Beneficially, the bottom end plate provides a seal against the first end of the tandem sub to protect the addressable switch from a pressure wave generated by detonation of charges in the upstream gun barrel.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

DEFINITIONS

Figure 1:
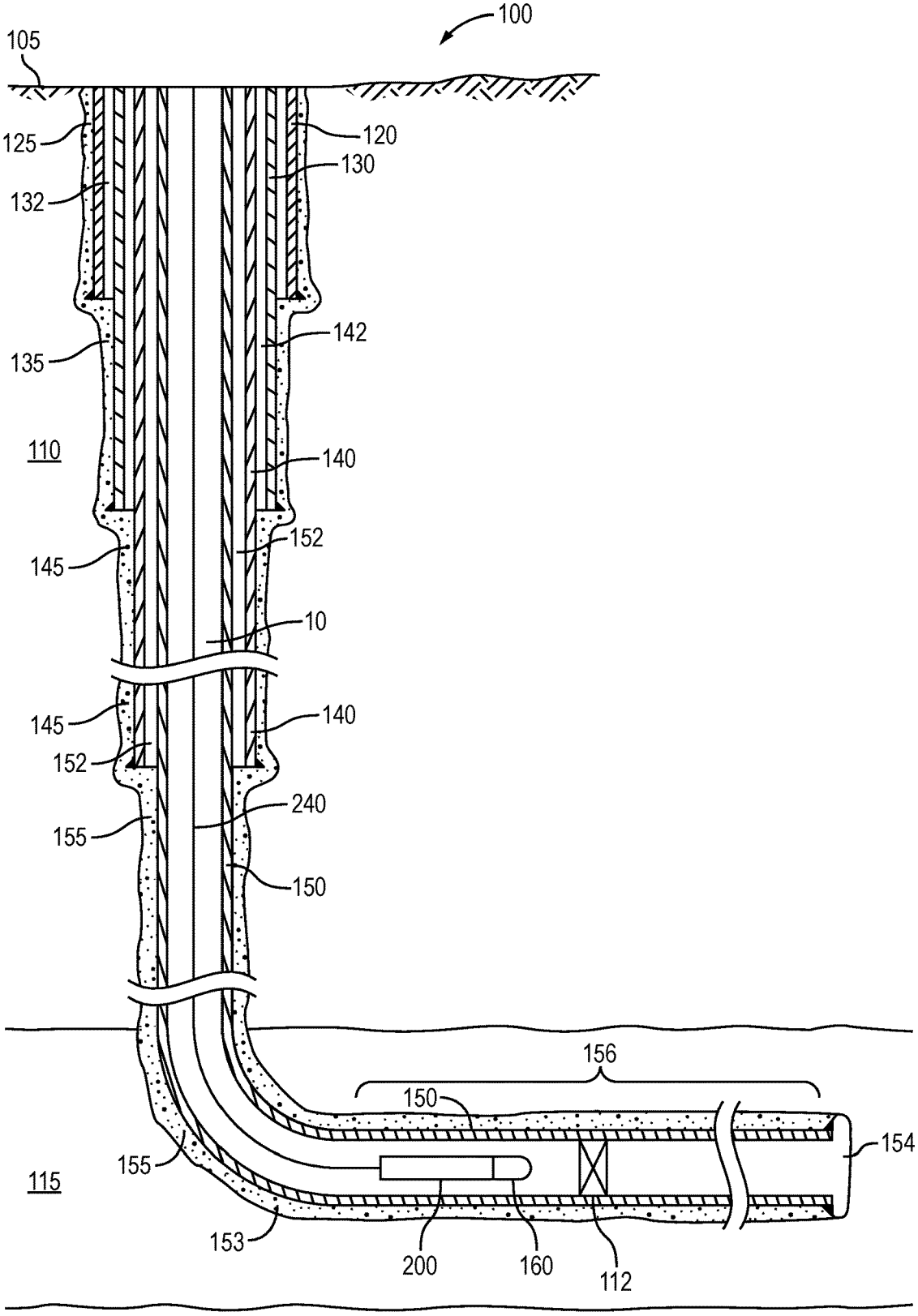
FIG. 1 (Prior Art)
FIG. 1 is a cross-sectional side view of a wellbore. The wellbore is being completed with a horizontal leg. A perforating gun assembly is shown having been pumped into the horizontal leg at the end of an e-line.

For purposes of the present application, it will be understood that the term "hydrocarbon" refers to an organic compound that includes primarily, if not exclusively, the elements hydrogen and carbon. Hydrocarbons may also include other elements, such as, but not limited to, halogens, metallic elements, nitrogen, carbon dioxide, and/or sulfuric components such as hydrogen sulfide.

As used herein, the terms "produced fluids," "reservoir fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, nitrogen, carbon dioxide, hydrogen sulfide and water.

As used herein, the term "fluid" refers to gases, liquids, and combinations of gases and liquids, as well as to combinations of gases and solids, combinations of liquids and solids, and combinations of gases, liquids, and solids.

As used herein, the term "subsurface" refers to geologic strata occurring below the earth's surface.

As used herein, the term "formation" refers to any definable subsurface region regardless of size. The formation may contain one or more hydrocarbon-containing layers, one or more non-hydrocarbon containing layers, an overburden, and/or an underburden of any geologic formation. A formation can refer to a single set of related geologic strata of a specific rock type, or to a set of geologic strata of different rock types that contribute to or are encountered in, for example, without limitation, (i) the creation, generation and/or entrapment of hydrocarbons or minerals, and (ii) the execution of processes used to extract hydrocarbons or minerals from the subsurface region.

As used herein, the term "wellbore" refers to a hole in the subsurface made by drilling or insertion of a conduit into the subsurface. A wellbore may have a substantially circular cross section, or other cross-sectional shapes. The term "well," when referring to an opening in the formation, may be used interchangeably with the term "wellbore."

Reference herein to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment.

Detailed Description of Certain Embodiments

The following description of the embodiments refers to the accompanying drawings. The same reference numbers in different drawings identify the same or similar elements. The following detailed description does not limit the invention; instead, the scope of the invention is defined by the appended claims. The following embodiments are discussed, for simplicity, with regard to attaching two perforating guns to each other through a tandem sub. In the following, the terms "upstream" and "downstream" are being used to indicate that one gun barrel may be situated above and one below, respectively. However, one skilled in the art would understand that the invention is not limited only to the upstream gun or only to the downstream gun, but in fact can be applied to either gun. In other words, the terms "upstream" and "downstream" are not necessarily used in a restrictive manner, but only to indicate, in a specific embodiment, the relative positions of perforating guns or other components.

Figure 3:
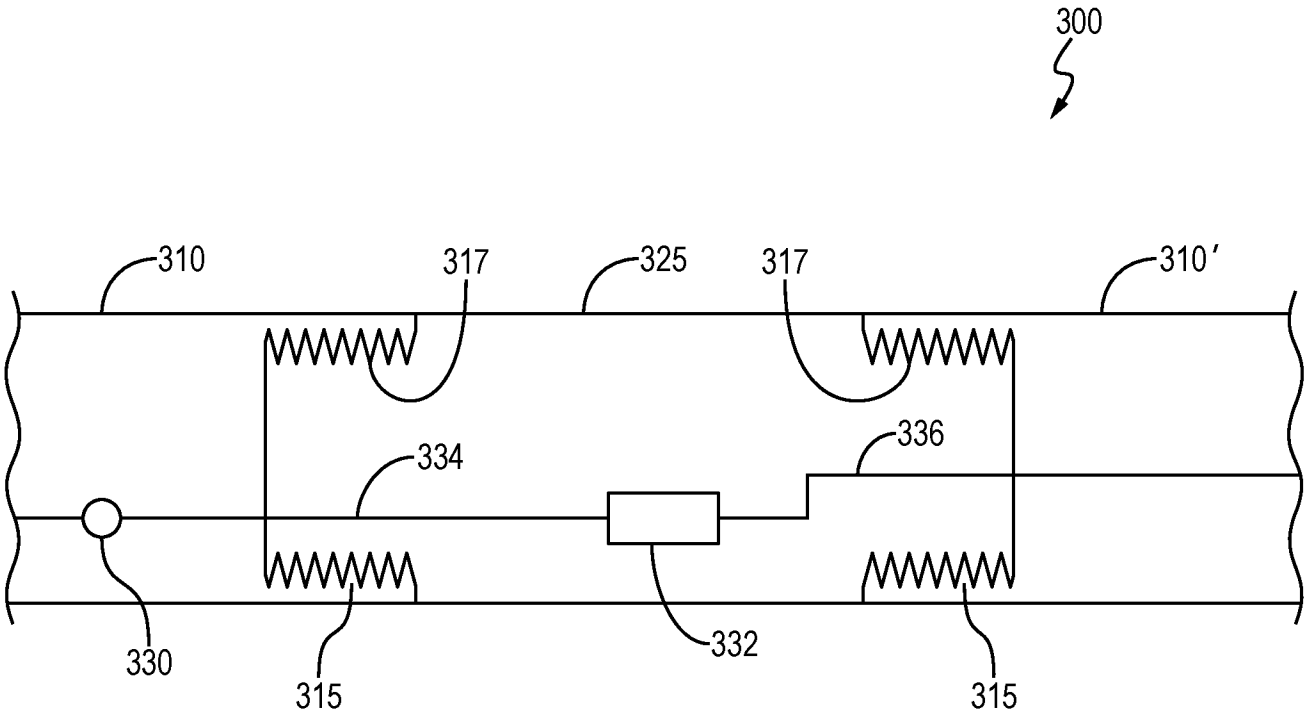
FIG. 3 (Prior Art)
FIG. 3 is a schematic side view of a tandem sub. A gun barrel is connected to each of opposing ends of the tandem sub.

FIG. 3 is a cross-sectional view of a portion of a perforating gun assembly 300. The perforating gun assembly 300 is shown schematically, and first comprises a tandem sub 325. The perforating gun assembly 300 also includes a first perforating gun 310 at a first end of the tandem sub 325, and a second perforating gun 310' at a second opposite end of the tandem sub 325.

Each perforating gun 310, 310' comprises a tubular housing having first and second opposing ends. Each end comprises female threads 315. In the view of FIG. 3, the tandem sub 325 has male threaded ends 317 that connect to respective perforating guns 310, 310' via the female threads 315. Thus, the tandem sub 325 is used to connect gun barrels of perforating guns 310 in series.

An electronic switch 332 is located inside the tandem sub 325. The switch 332 is electrically connected through signal line 334 to an upstream e-wireline (shown at 240 in FIG. 1) for receiving instruction signals from the surface. In the view of FIG. 3, the signal line 334 extends into the first perforating gun 310. A separate signal line 336 connects the switch 332 to the second perforating gun 310'. The second signal line 336 sends instructions signals from the surface on to perforating guns that are downstream of switch 332. It is understood that signal lines 334 and 336 may be considered as a single signal line that extends along the entire length of a perforating gun assembly 200 when the tool is run into a wellbore 100.

FIG. 3 shows a simplified configuration in which signal line 334 is connected to a shaped charge 330. One skilled in the art would understand that a detonator is connected to signal line 334, and the detonator ignites explosive material within a detonating cord, which in turn detonates a plurality of shaped charges like charge 330. It is further understood that each perforating gun 310, 310', etc. in a perforating gun assembly 200 will likely have its own detonator.

Where a series of gun barrels is used in a perforating gun assembly 300, the signal from the wireline 240 will be transmitted through the series of gun barrels 310, 310', etc. and corresponding contact pins (shown at 670 in FIGS. 10 and 14) to the perforating guns intended to be activated. Typically, guns are activated in series, from the downstream end of the tool string, up. Instructions signals are sent through the perforating gun assembly by means of the signal line 334/336.

The switches "listen" for a detonation signal sent through the signal line 334/336. When a detonation signal is received, the switch 332 sends a corresponding detonation signal through the line 334 to the detonator (not shown) for activating a shaped charge 330 (also shown at 520 in FIG. 5) of the first (or upstream) perforating gun 310.

In FIG. 3, the first perforating gun 310 is located upstream from the second perforating gun 310'. When a detonation charge in perforating gun 310' is detonated, debris from the detonation likely will not enter the tandem sub 325. However, when the detonation charges in upstream perforating gun 310 are later detonated, debris from the detonation along with wellbore fluid and/or a pressure wave will enter the tandem sub 325 and damage the switch 332. Although the tandem sub 325 may be reusable after the detonation of the perforating gun 310, the electronics 332 inside the tandem sub 325 are not. This means that when the assembly 300 is brought to the surface 105 and prepared for another deployment, the electronics 332 inside the tandem sub 325 need to be replaced. Further, the inside chamber of the sub 325 needs to be cleaned. These steps add to the cost of the perforating operation.

Thus, it is desirable to have a detonation system wherein the inside electronics are protected from the debris and wellbore fluids generated by the pressure wave caused by the detonation of the upstream charges so that, after a perforating process is completed, both the tandem sub 325 and its electronics 332 can be reused. It is also desirable to provide a novel tandem sub having an inner bore that contains a switch housing with an electrical switch, coupled with a novel end plate that receives pins for communicating detonation signals and instruction signals. This may be referred to herein as a sealed explosive initiation assembly.

Figure 4:
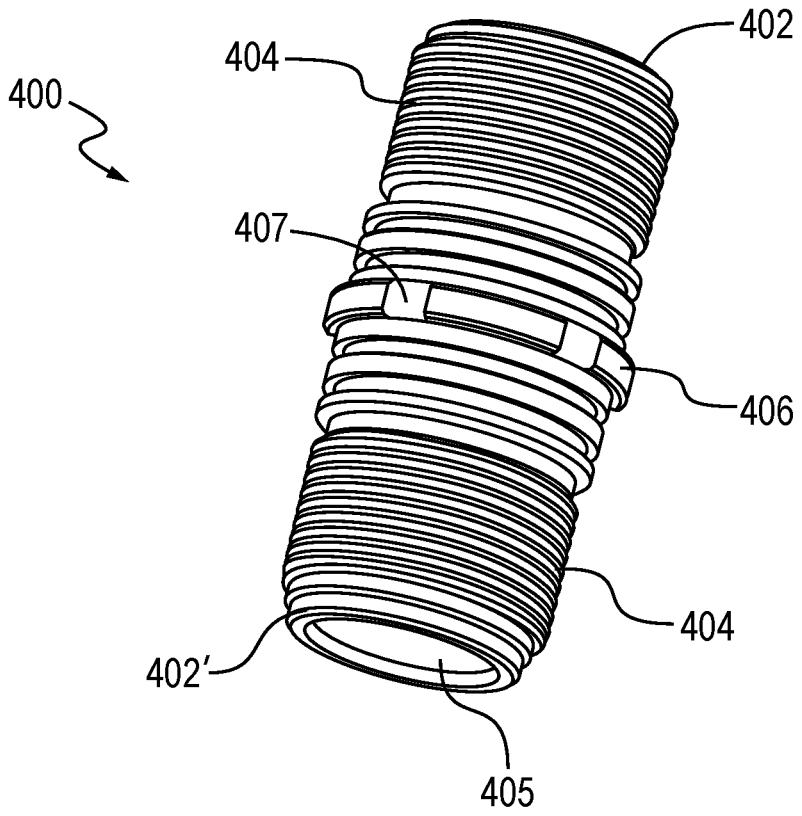
FIG. 4 is a perspective view of a tandem sub of the present invention, in one embodiment.

FIG. 4 is a perspective view of an illustrative tandem sub 400. The tandem sub 400 defines a short tubular body having a first end 402 and a second opposing end 402'. The tandem sub 400 may be, for example, 0.25 inches to 5.5 inches in length, with the two ends 402, 402' being mirror images of one another. Preferably, the tubular body forming the tandem sub 400 is portless, as shown in FIG. 4.

The tandem sub 400 includes externally machined threads 404. The threads 404 are male threads dimensioned to mate with female threaded ends 315 of a gun barrel housing, such as perforating guns 310, 310' of FIG. 3. The tandem sub 400 is preferably dimensioned in accordance with standard 3-⅛" gun components. This allows the tandem sub 400 to be threadedly connected in series with perforating guns from any American vendor, e.g., Geo-Dynamics® and Titan®.

Interestingly, if the operator begins having multiple misruns due to a problem with the detonator, then the portless tandem sub 400 (and internal electronic assembly 600, described below) allow the operator to switch to a new batch number, or even to switch vendors completely. The detonation system of the present invention also allows the operator to select the gun lengths, shot densities and phasing that are available on the market. Thus, a plug-n-play system that may be used with perf guns from different vendors is provided.

Intermediate the length of the tandem sub 400 and between the threads 404 is a shoulder 406. The shoulder 406 serves as a stop member as the tandem sub 400 is screwed into the end 317 of a gun barrel 310. Optionally, grooves 407 are formed equi-radially around the shoulder 406. The grooves 407 cooperate with a tool (not shown) used for applying a rotational force to the tandem sub 400 without harming the rugosity of the shoulder 406.

The tandem sub 400 includes a central bore 405. As will be described in greater detail below, the bore 405 is dimensioned to hold novel electronics associated with a perforating gun assembly 210. Such electronics represent an electronic switch housing as shown at 650 in FIG. 10, an addressable switch 660 shown in FIG. 13, a contact pin 670 shown in FIG. 21, a signal transmission pin 720', a detonator pin 720", and a ground pin 710 shown in FIG. 7A.

Figure 5:
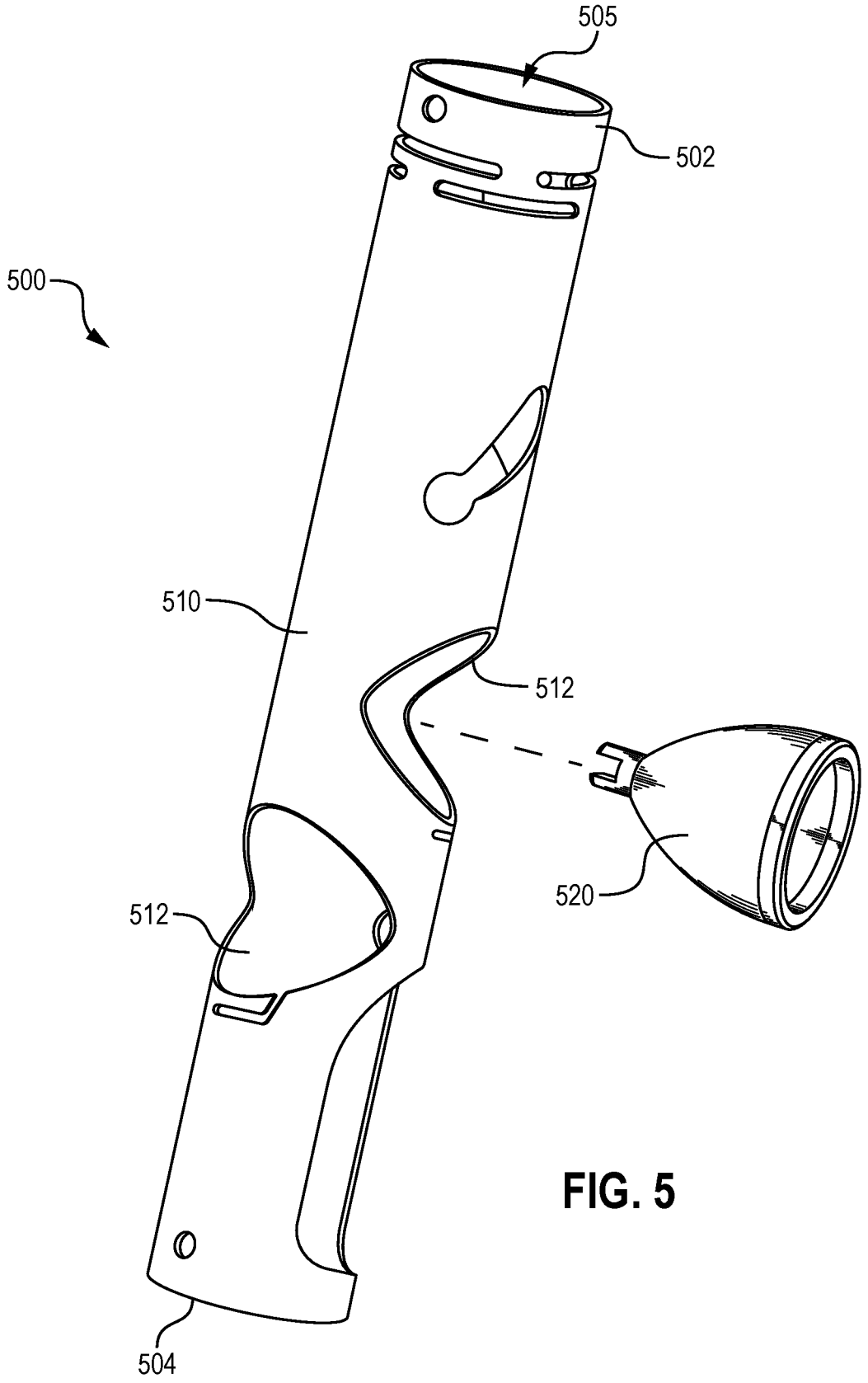
FIG. 5 is a perspective view of an illustrative carrier tube for a perforating gun.

FIG. 5 is a perspective view of an illustrative carrier tube 500 for a perforating gun 210. The carrier tube 500 defines an elongated tubular body 510 having a first end 502 and a second opposing end 504. The carrier tube 500 has an inner bore 505 dimensioned to receive charges. A single illustrative charge is shown at 520 in exploded-apart relation. Openings 512 are provided for receiving the charges 520 and enabling the charges 520 to penetrate a surrounding casing string 150 upon detonation.

Figure 6A:
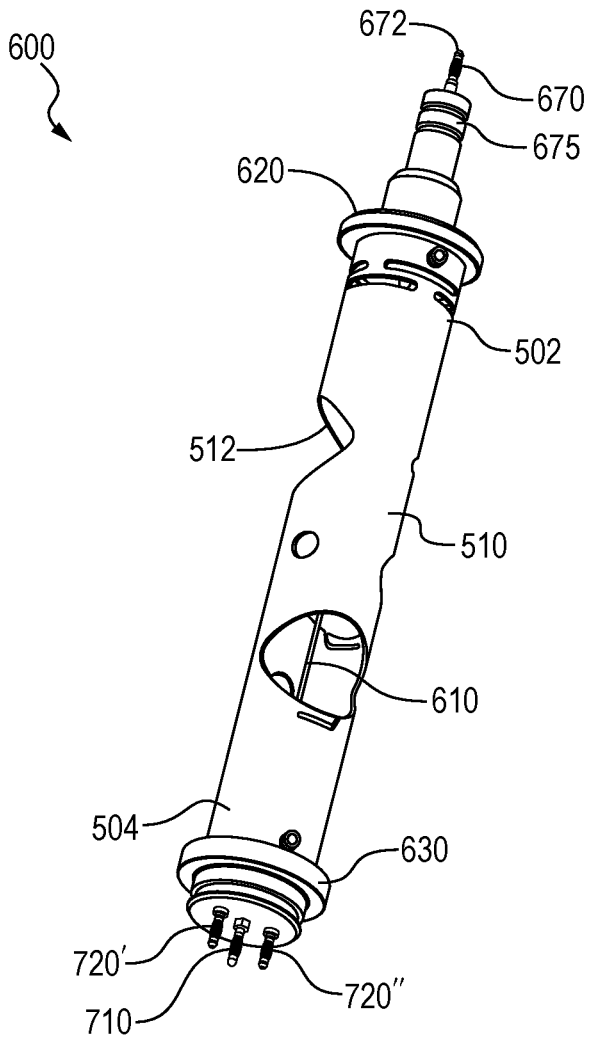
FIG. 6A is a perspective view of the carrier tube of FIG. 5. The carrier tube has received a top end plate and a bottom end plate. An electric line is shown extending through the carrier tube, through the bottom end plate, and down from the tool.

FIG. 6A is a perspective view of the carrier tube 500 of FIG. 5. In this view, a pair of end plates have been threadedly connected to opposing ends of the carrier tube 500. These represent a top end plate 620 connected at end 502, and a bottom end plate 630 connected at the bottom end 504. The end plates 620, 630 have mechanically enclosed the top 502 and bottom 504 ends of the carrier tube 500, respectively. The end plates 620, 630 help center the carrier tube 500 and its charges 520 within an outer gun barrel (not shown in FIG. 6A but shown at 310 in FIG. 6B).

It is understood that each opening 510 along the carrier tube 500 will receive and accommodate a shaped charge 520. Each shaped charge 520, in turn, is designed to detonate in response to an explosive signal passed through a detonating cord. It is understood that the carrier tube 500 and the shaped charge 520 are illustrative, and that the current inventions are not limited to any particular type, model or configuration of charges, carrier tubes or gun barrels unless expressly so provided in the claims.

Figure 2:
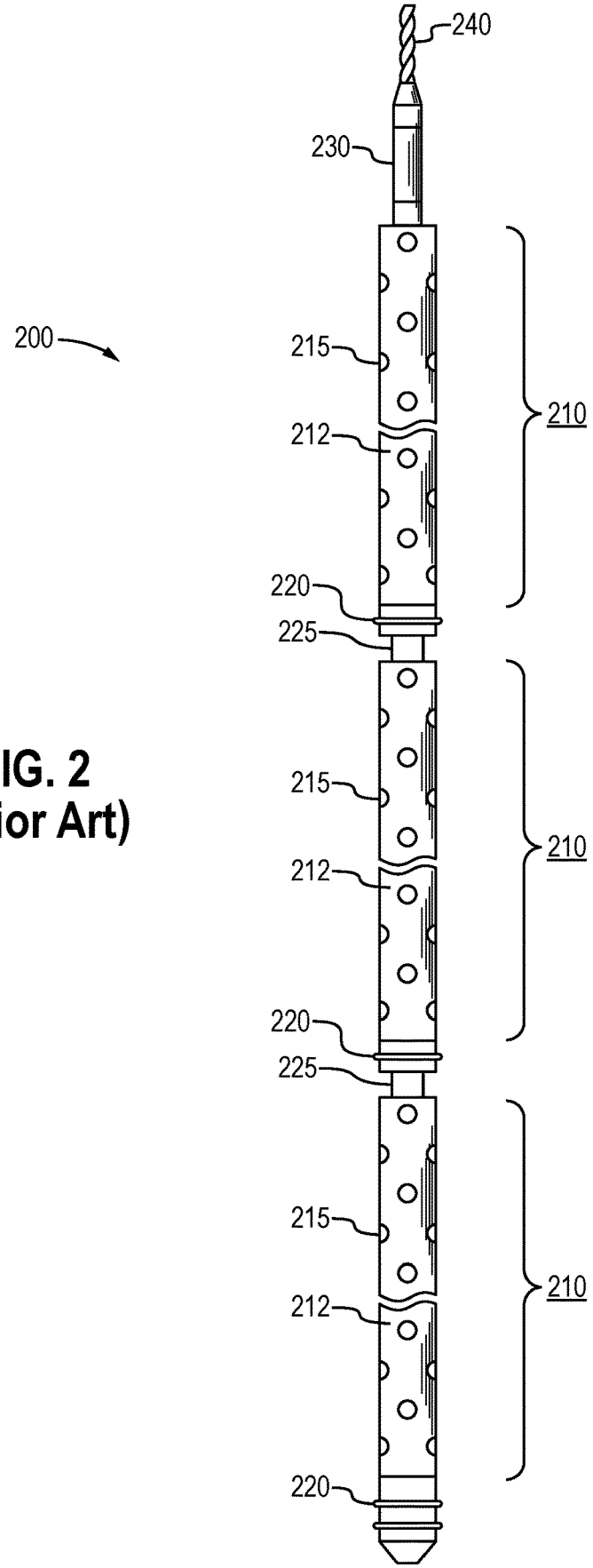
FIG. 2 (Prior Art)
FIG. 2 is a side view of a perforating gun assembly. The perforating gun assembly represents a series of perforating guns having been threadedly connected end-to-end. Tandem subs are shown between gun barrels of the perforating guns, providing the threaded connections.

An electronic detonator and a detonating cord (shown at 594 and 595, respectively, in FIG. 25C) reside inside the carrier tube 500. The carrier tube 500 and charges 520 together with the gun barrel 310 form a perforating gun (indicated at 210 in FIG. 2) while the perforating gun 210 along with the portless tandem sub 400, the end plates 620, 630, the detonator 594, the detonating cord 595 and the addressable switch 660 form a perforating gun assembly 600. The carrier tube 500 and the gun barrel 310 are intended together to be illustrative of any standard perforating gun, so long as the gun provides a detonator and detonating cord internal to the carrier tube 500.

Extending up from the top end plate 620 is a bulkhead 675. The bulkhead 675 encloses a contact pin 670. The contact pin 670 is configured to transmit detonation and communication signals from the surface, down to addressable switches along the perforating gun string. The contact pin 670 and bulkhead 675 are shown in greater detail in FIGS. 14 and 15A.

A signal line 610 is seen extending down from the contact pin 670 and through the carrier tube 500. The signal line 610 further extends through the bottom end plate 630, and down to a next perforating gun (not shown). Of interest, the signal line 610 is interrupted at the bottom end plate 630 by a transmission pin 720'. The transmission pin 720' is shown in greater detail in FIGS. 7A and 22B.

Figure 6B:
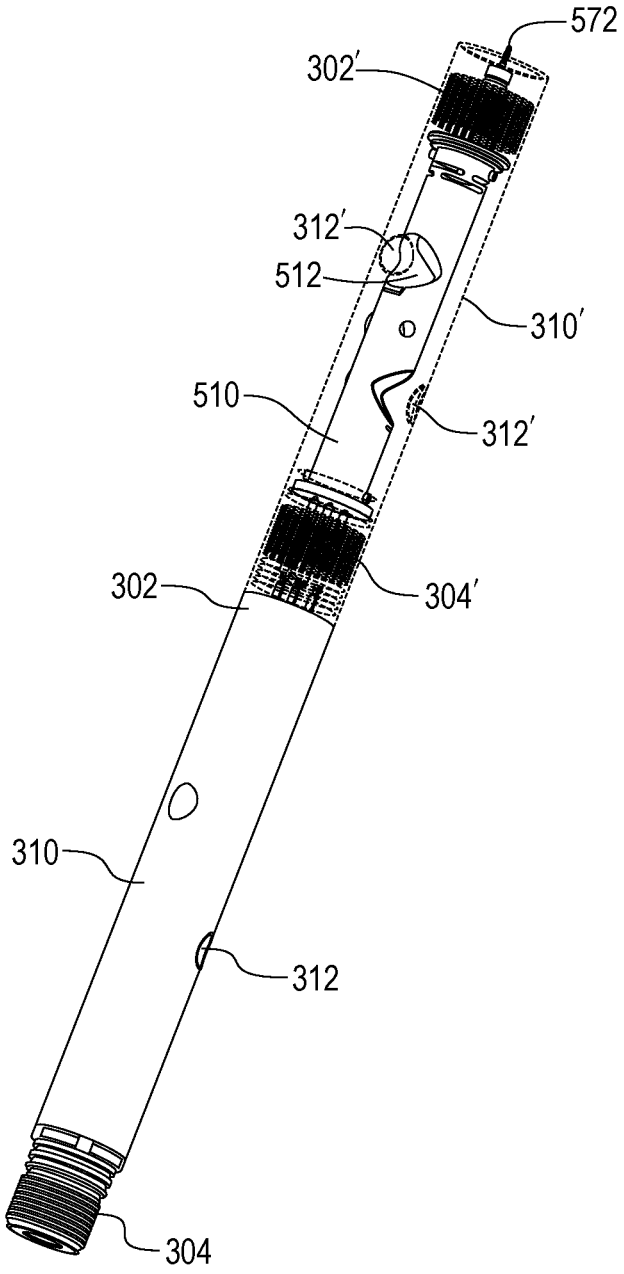
FIG. 6B is another perspective view of the carrier tube of FIG. 5. The carrier tube is slidably receiving a gun barrel housing.

FIG. 6B is another perspective view of the carrier tube 500 of FIG. 5. Here, the carrier tube 500 is slidably receiving a gun barrel housing 310. The gun barrel housing 310 has an upper end 302 and a lower end 304. The gun barrel housing 310 has a length that is generally conterminous with the length of the carrier tube 500. The gun barrel housing 310 includes openings 312 that align with openings 512 of the carrier tube 500 when the gun barrel housing 310 is slid in place over the carrier tube 500.

In the view of FIG. 6B, the gun barrel housing 310 is shown in phantom when placed over the carrier tube 500. The upper end is indicated at 302' while the lower end is shown at 304'. Openings along the gun barrel housing 310 are provided at 312'. It is understood that this assembly typically takes place at the shop before delivery of a perforating gun assembly to a well site.

Figure 7A:
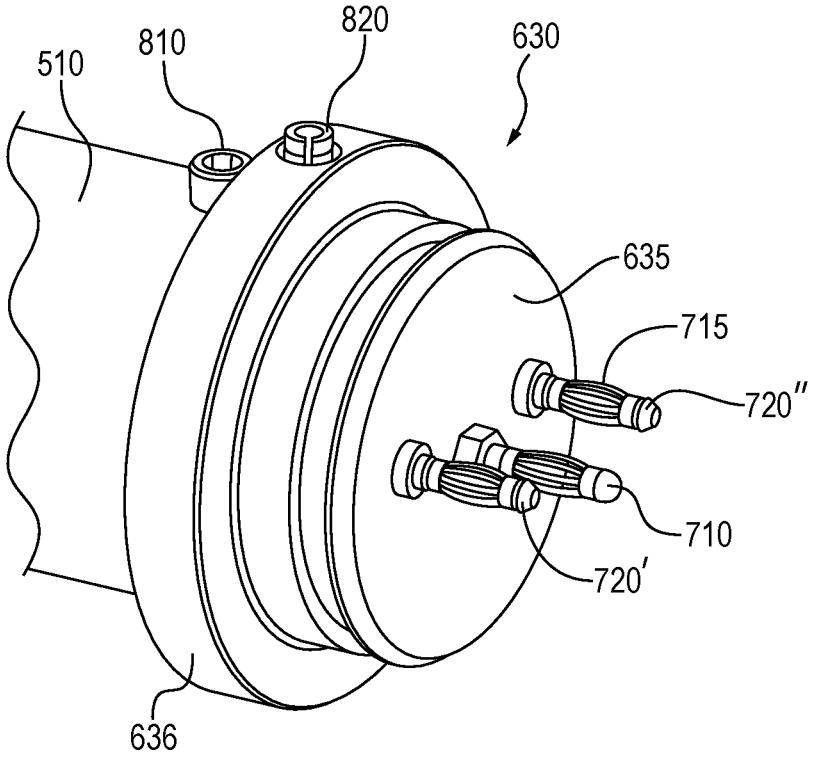
FIG. 7A is a first perspective view of the bottom end plate of FIG. 6A. The end plate is connected to the carrier tube. Three signal pins are shown extending out of the end plate.

FIG. 7A is a first perspective view of the bottom end plate 630 of FIG. 6A. The end plate 630 is slidably connected to the body 510 of the carrier tube 500 at end 504. Bolt 810 threadedly connects a proximal end (shown at 632 in FIG. 11B) to the lower end 504 of the carrier tube 500.

The end plate 630 has a closed end surface 635. Three separate pins are seen extending out of the closed end surface 635. These represent a ground pin 710 and two electrical contact pins 720', 720". In one aspect, ground pin 710 connects to the bottom end plate 630 as an electrical ground, while contact pins 720', 720" connect to white and green wires, respectively.

Figure 7B:
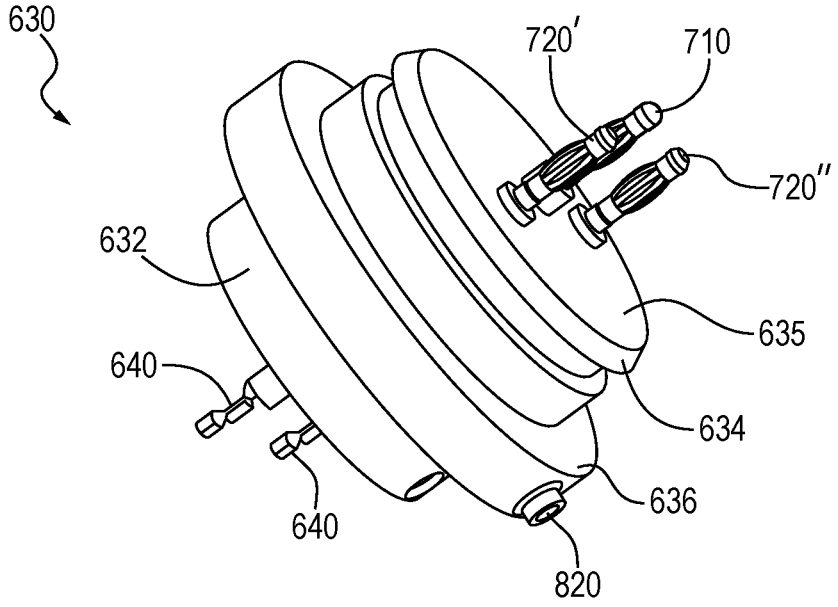
FIG. 7B is a second perspective view of the bottom end plate. The carrier tube has been removed for illustrative purposes.

FIG. 7B is a second perspective view of the bottom end plate 630. In this view, the proximal end 632 and distal end 634 of the plate 630 are visible. Also shown is the closed end surface 635 and a central flange 636. The central flange 636 receives the lowermost end 504 of the gun barrel housing 310. The central flange 636 also receives bolt 820. In addition, the ground pin 710 and electrical pins 720', 720" are visible.

Figure 8:
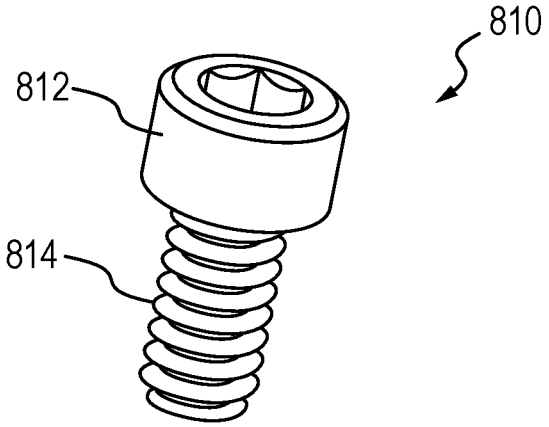
FIG. 8 is a perspective view of a bolt as may be used to connect the carrier tube to the top end plate.

FIG. 8 is a perspective view of the bolt 810. The bolt 810 includes a head 812 at a top end, and a threaded lower end 814. An internal surface of the head 812 optionally defines a hex opening for receiving a suitably sized Allen wrench.

Figure 9A:
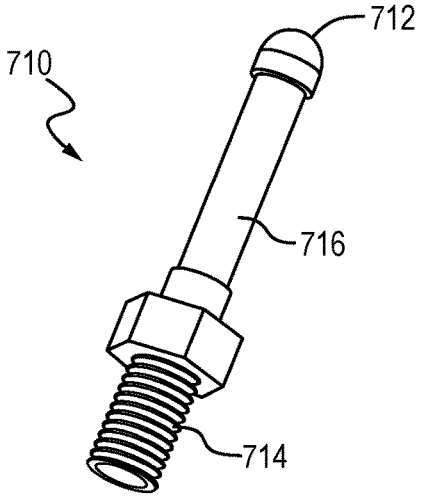
FIG. 9A is a first perspective view of one of the contact pins of FIGS. 7A and 7B. In this instance, the contract pin is a ground post.

FIG. 9A is a first perspective view of the ground pin 710 of FIGS. 6A and 7A. It can be seen that the ground pin 710 includes a tip 712, an end thread 714, and an elongated body 716 therebetween. End thread 714 screws into the closed end face 635. In this way the closed end surface 635 can support the pin 710. Also, being conductive to the endplate 630, the pin 710 carries ground for the switch signal.

Figure 9B:
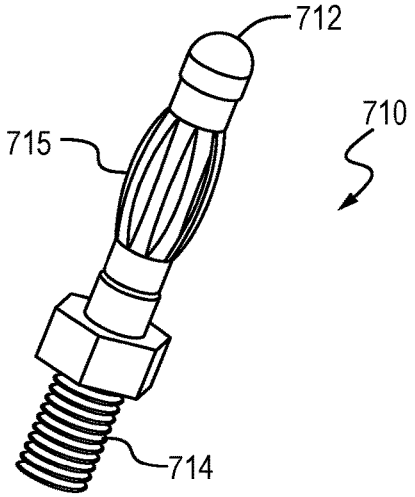
FIG. 9B is a second perspective view of the ground post of FIGS. 7A and 7B. Here, the post has received a centralizer.

FIG. 9B is a second perspective view of the ground pin 710 of FIG. 6A. Here, the ground pin 710 has received a centralizer 715 along its body 716. The centralizer 715 enables the pin (or "post") 710 to successfully mate with one of the terminals 640 (shown in FIG. 20) that are embedded in the switch housing 650.

Figure 10:
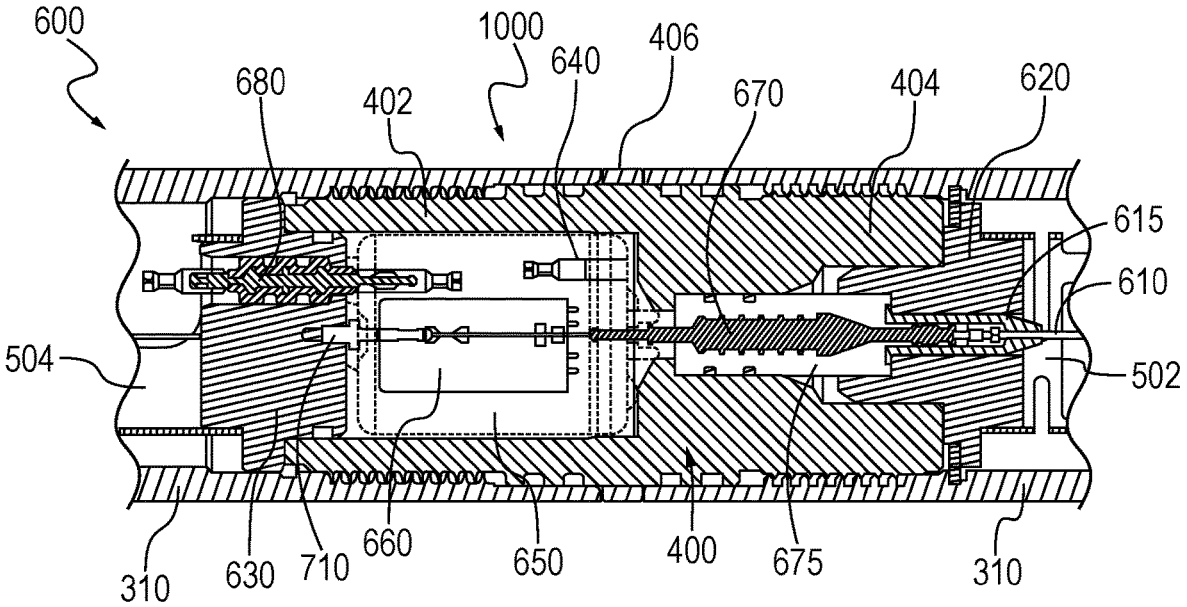
FIG. 10 is a side, cross-sectional view of an explosive initiation assembly of the present invention, in one embodiment. The explosive initiation assembly is threadedly connected at opposing ends to gun barrel housings, forming a perforating gun assembly. The explosive initiation assembly includes, among other components, a tandem sub, a switch housing and an addressable switch.

FIG. 10 is a side, cross-sectional view of an explosive initiation assembly 1000 of the present invention, in one embodiment. The explosive initiation assembly 1000 is threadedly connected at opposing ends to gun barrel housings 310, forming a part of the perforating gun assembly 600 of FIG. 6A.

The explosive initiation assembly 1000 first includes a switch housing 650. The switch housing 650 resides within a bore of the tandem sub 400.

The explosive initiation assembly 1000 also includes an addressable switch 660. The addressable switch 660 resides within the switch housing 650. The addressable switch 660 receives signals sent from the surface as sent by an operator, and filters those signals to identify an activation signal. If an activation signal is identified, then a signal is initiated for detonation of charges in an adjacent (typically upstream) perforating gun 310.

The tandem sub 400 and its switch housing 650 reside between the bottom plate 630 and the top plate 620. Flange members 636, 626 associated with the bottom end plate 630 and the top end plate 620, respectively, abut opposing ends of the tandem sub 400. Beneficially, the end plates 630, 620 mechanically seal the tandem sub 400, protecting the addressable switch 660 from wellbore fluids and debris generated during detonation of the charges 520.

The explosive initiation assembly 1000 also includes a contact pin 670. The contact pin 670 resides within a non-conductive bulkhead 675. A proximal end of the contact pin 670 extends into the top end plate 620 while a distal end of the contact pin 670 extends into the switch housing 650.

It can be seen that the signal transmission line 610 is connected to the proximal end of the contact pin 670. The signal transmission line 610 is protected along the top end plate 620 by means of a tubular insulator 615.

The explosive initiation assembly 1000 further includes a detonation pin 680. The detonation pin 680 also resides within a non-conductive bulkhead 685. A proximal end of the detonation pin 680 resides within an adjacent carrier tube 500, while a distal end extends into the switch housing 650. Note that the detonation pin 680 is the same as pin 720" of FIG. 6A. Note also that each of transmission pins 720' and 720" are encased in a bulkhead 685 (although pin 720' is not visible in the cut of FIG. 10).

Figure 11A:
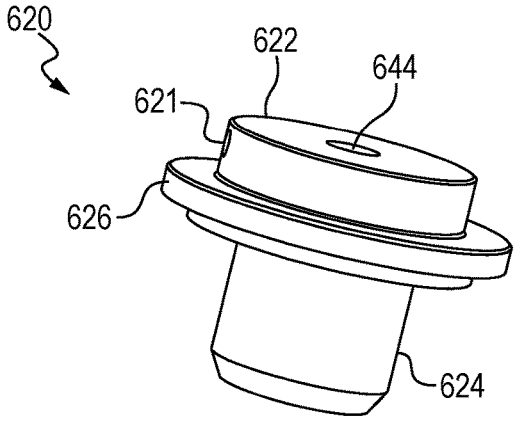
FIG. 11A is a perspective view of a top end plate that is part of the perforating gun assembly. The top end plate seats against the downstream end of the tandem sub.

FIG. 11A is a perspective view of the top end plate 620 that is part of the perforating gun assembly 600, in one embodiment. The top end plate 620 has a proximal end 622 and a distal end 624. Intermediate the proximal 622 and distal 624 ends is the flange 626. As shown in FIG. 10, the downstream end of the tandem sub 400 shoulders out against the flange 626.

The proximal end 622 of the top end plate 620 comprises a threaded opening 621. The threaded opening 621 is configured to receive a bolt or pin (not shown) that radially fixes the top end plate to the top of the carrier tube 510.

Figure 11B:
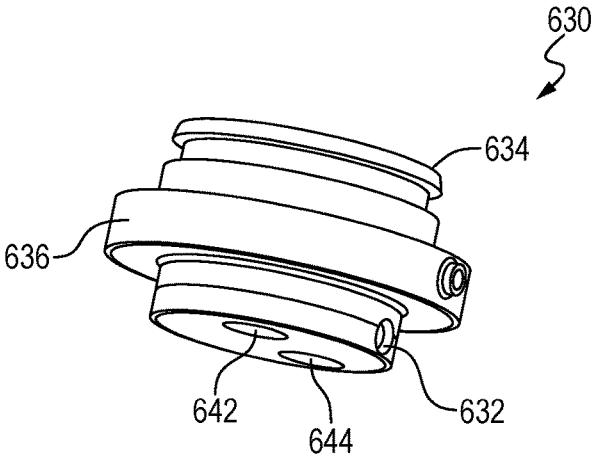
FIG. 11B is a perspective view of a bottom end plate that is part of the perforating gun assembly. The bottom end plate seats against the upstream end of the tandem sub.

FIG. 11B is a perspective view of the bottom end plate 630 that is part of the perforating gun assembly 600, in one embodiment. The bottom end plate 630 seats against the upstream end of the tandem sub 400. The bottom end plate 630 has a proximal end 632 and a distal end 634. Intermediate the proximal 632 and distal 634 ends is a flange 626.

At the proximal end 632 of the end plate 630 are two openings 642, 644. One of the openings 642 is dimensioned to receive the detonation pin 680 (or 720") and the corresponding bulkhead 685. The other opening 644 receives a transmission pin 720' and its own corresponding bulkhead 685. The transmission pin 720' and the detonator pin 720" extend from inside the switch housing 650 to inside the bottom end plate 630.

Figure 12:
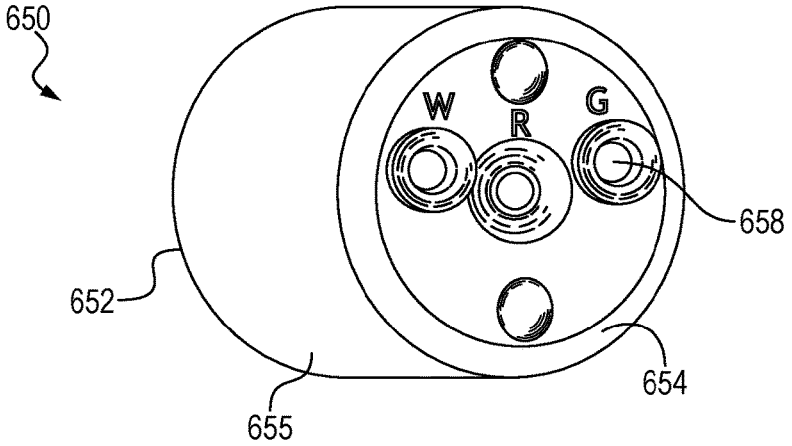
FIG. 12 is a perspective view of a switch housing. The switch housing holds the addressable switch within a tandem sub.

FIG. 12 is a perspective view of the switch housing 650 of the explosive initiation assembly 1000 of FIG. 10. The switch housing 650 defines a cylindrical body 655 having a proximal end 652 and a distal end 654. Preferably, the switch housing 650 is fabricated from a shock-absorbing rubber compound.

Each end 652, 654 of the switch housing 650 includes contact ports. In the view of FIG. 12, contact ports 658 are visible at the distal end 654. The contact ports 658 are labeled "W", "R" and "G", indicating White, Red and Green. In electrical parlance, white (or sometimes black) indicates a negative wire or contact; red indicates a positive wire or contact, and green indicates the ground wire or contact. In the present arrangement, white indicates a signal line, red is the ground, and green is the detonation line. Signal pin 720' goes to white, detonator pin 720" goes to green, and ground pin (or post) 710 goes to red.

The contact ports 658 are dimensioned to closely receive the ground pin 710 and the electrical pins 720.

Figure 13:
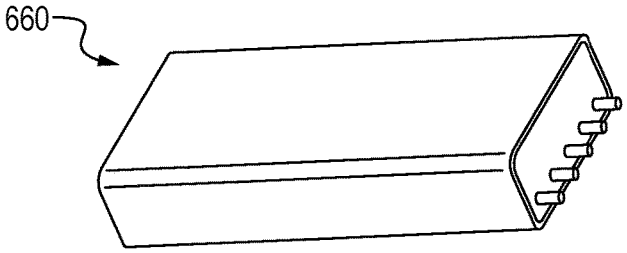
FIG. 13 is a perspective view of an addressable switch. The addressable switch resides within the switch housing of FIG. 12.

FIG. 13 is a perspective view of the addressable switch 660 of the present invention, in one embodiment. The addressable switch 660 contains electronics such as a circuit board or perhaps a 3-pin push-on connector. The addressable switch 660 is installed in the switch housing 650 and placed in electrical communication with the ground pin 710, the signal transmission pin 720', and the detonation pin 680/720".

Figure 14:
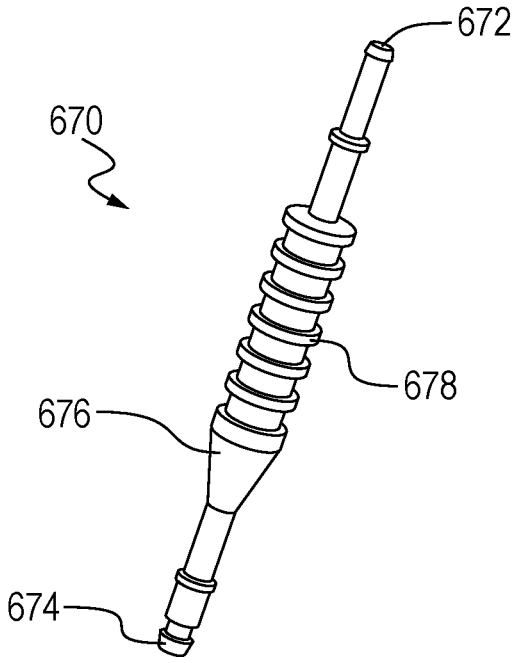
FIG. 14 is a perspective view of a contact pin. The contact pin is part of the explosive initiation assembly of FIG. 10 and is used to transmit detonation signals from the electric line to downstream perforating guns.

FIG. 14 is a perspective view of the contact pin 670 of FIG. 10. It can be seen that the contact pin 670 has a proximal end 672 and a distal end 674. The proximal end 672 defines a contact head 672 that resides within the switch housing 650. Intermediate the proximal end 672 and the distal end 674 is an elongated body, or shaft 676. The elongated shaft 676 is fabricated from an electrically conductive material, such as brass. The shaft optionally includes a series of flanges 678 designed to strengthen the pin 670 within the bulkhead 675.

Figure 15A:
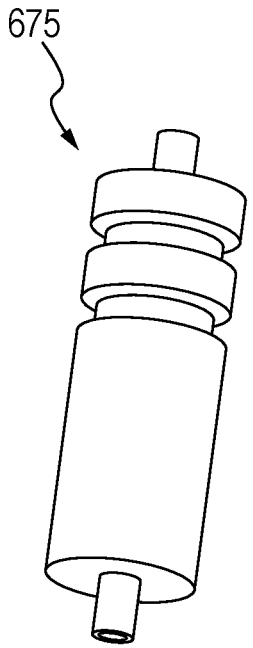
FIG. 15A is a perspective view of a bulkhead. The bulkhead is configured to frictionally encapsulate the contact pin of FIG. 14.

FIG. 15A is a perspective view of the bulkhead 675. The bulkhead 675 is fabricated from a non-conductive material such as plastic (poly-carbonate) or nylon.

Figure 15B:
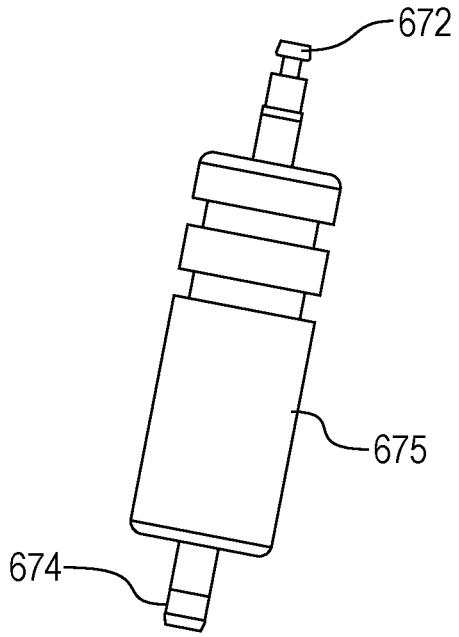
FIG. 15B is a perspective view of the bulkhead of FIG. 15A holding the contact pin of FIG. 14. A contact head is seen extending out from the bulkhead. The contact head is configured to extend up into a switch housing.

FIG. 15B is a perspective view of the bulkhead 675, with the electrical contact pin 670 residing therein. In FIG. 15B, the contact head 672 at the end of the contact pin 670 is visible. The contact head 672 is configured to extend up into the switch housing 650 and to transmit electrical current from the signal line 240 (and ground post 710) to a next perforating gun as electrical communication and detonation signals.

Figure 16:
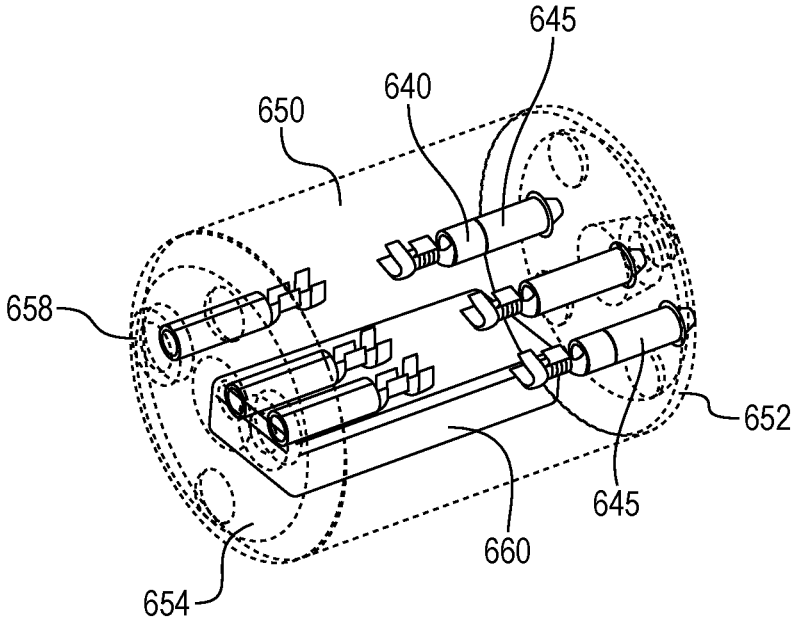
FIG. 16 is a first transparent perspective view of the switch housing of FIG. 12. The addressable switch of FIG. 13 is visible in this view. Also visible is a plurality of contact clips configured to support contact prongs.

FIG. 16 is a first transparent perspective view of the switch housing 650 of FIG. 12. The addressable switch 660 is visible in this view. Also visible is a plurality of wiring terminals 640. Each wiring terminal 640 extends into the switch housing 650. The wiring terminals 640 reside on the back sides of respective contact openings 658.

At the proximal end 652 of the switch housing 650, the wiring terminals 640 support contacts 645. An enlarged view of a contact 645 is shown at FIG. 25 and is described below.

At the distal end 654 of the switch housing 650, the wiring terminals 640 support ground pin 710 and electrical pins 720', 720". Pins 710, 720 are shown and described above in connection with FIGS. 7A, 7B, 9A and 9B.

Figure 17:
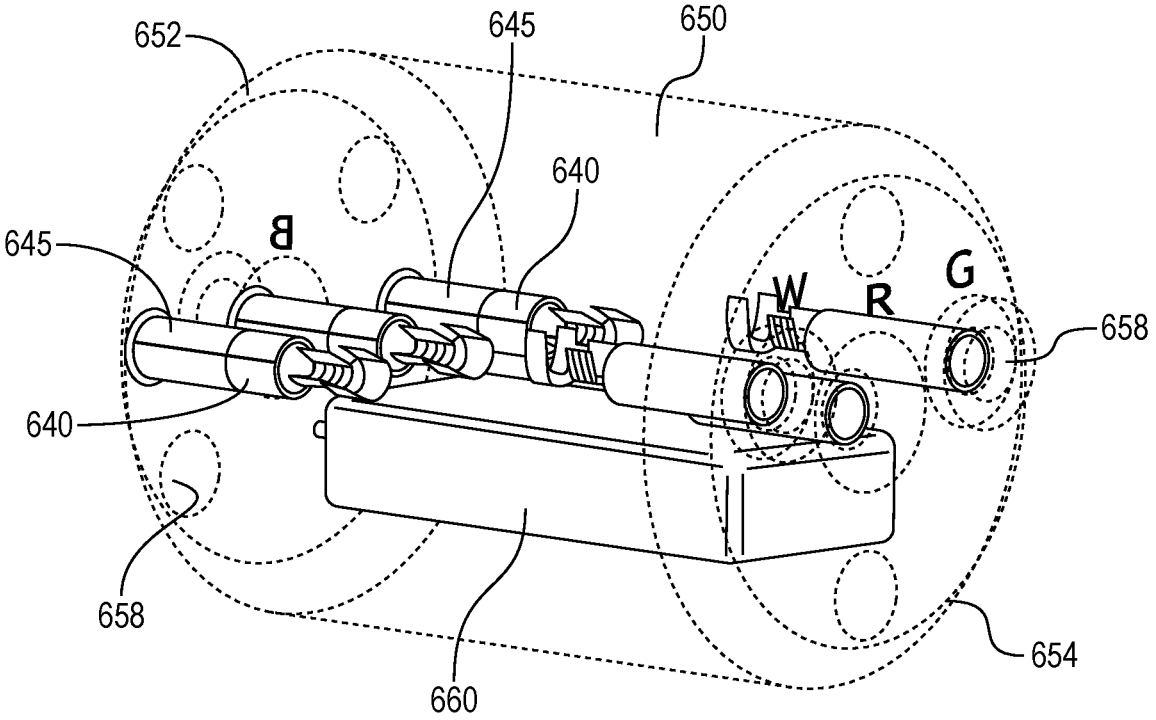
FIG. 17 is a second transparent perspective view of the switch housing of FIG. 12. This view is enlarged relative to the view of FIG. 16, and demonstrates the configuration of the contact clips more clearly.

FIG. 17 is a second transparent perspective view of the switch housing 650 of FIG. 12. This view is enlarged relative to the view of FIG. 16. The addressable switch 660 is again visible in this view. FIG. 17 demonstrates the configuration of the wiring clips 640 within the switch housing 650 more clearly.

Figure 18:
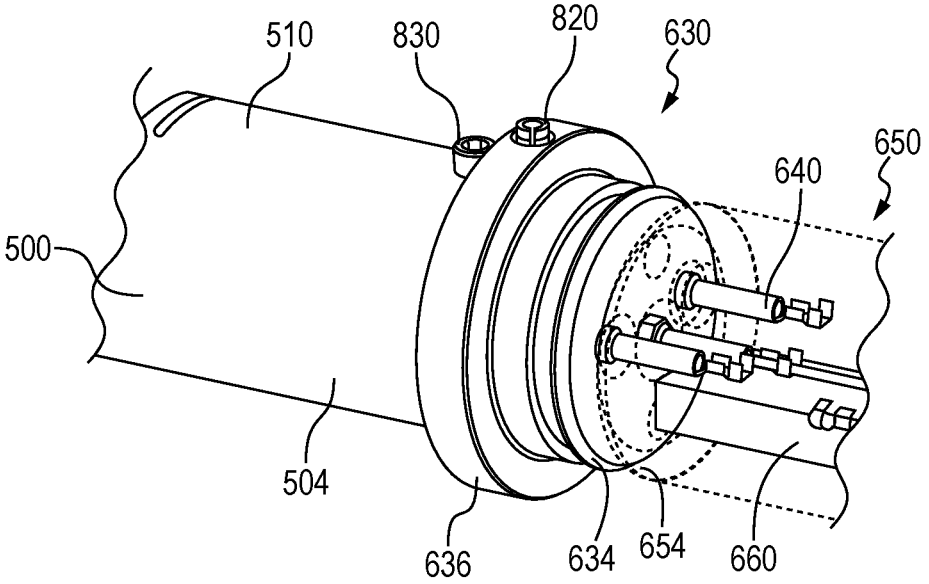
FIG. 18 is a third transparent perspective view of the switch housing of FIG. 12, or at least a portion of the switch housing. Here, the switch housing is sealingly connected to a bottom end plate. The bottom end plate, in turn, is connected to a carrier tube.

FIG. 18 is a third transparent perspective view of the switch housing 650 of FIG. 12. Here, the switch housing 650 is sealingly connected to a bottom end plate 630. The bottom end plate 630, in turn, is connected to a carrier tube 500.

Figure 19:
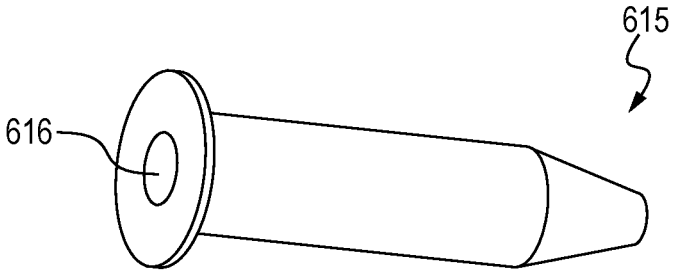
FIG. 19 is a perspective view of an insulator boot. Three insulator boots are used in the detonation system—two on the upstream side and one on the downstream side of an end plate.

FIG. 19 is a perspective view of an insulator boot 615. The insulator boot 615 is an optional item that may be used to protect the signal transmission pin 720' and the detonator pin 720". In one embodiment, three insulator boots 615 are used in the explosive initiation assembly 1000—two on the upstream side and one on the downstream side of an end plate.

The insulator boot 615 is preferably fabricated from a non-conductive material such as a rigid plastic. The insulator boot 615 includes an elongated bore 616. The bore 616 of a first boot 615 is configured to receive the distal end 674 of the contact pin 670 within the top end plate 620 after a terminal 640 and wire are connected. The bore 616 of a second boot 615 and of a third boot 615 cover ends 684 of respective signal transmission pin 720' and detonation transmission pin 720"/680, respectively, after terminals 640 and wires are installed.

Figure 20:
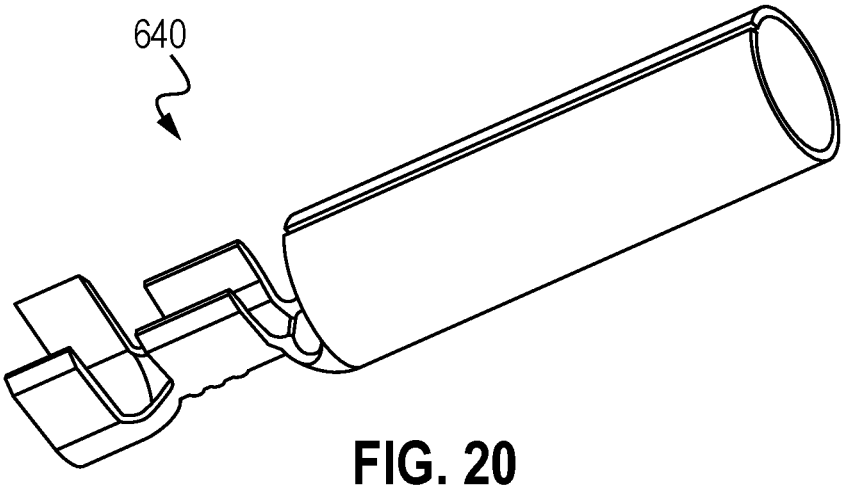
FIG. 20 is a perspective view of a connector clip used for providing secured wired connections within the switch housing.

FIG. 20 provides a perspective view of a wiring clip 640 as seen in FIGS. 16, 17 and 18. The wiring clips 640 resides within the switch housing 650, and is configured to secure a wire that electrically connects the addressable switch 660 with the pins 710, 720 and 670.

Figure 21:
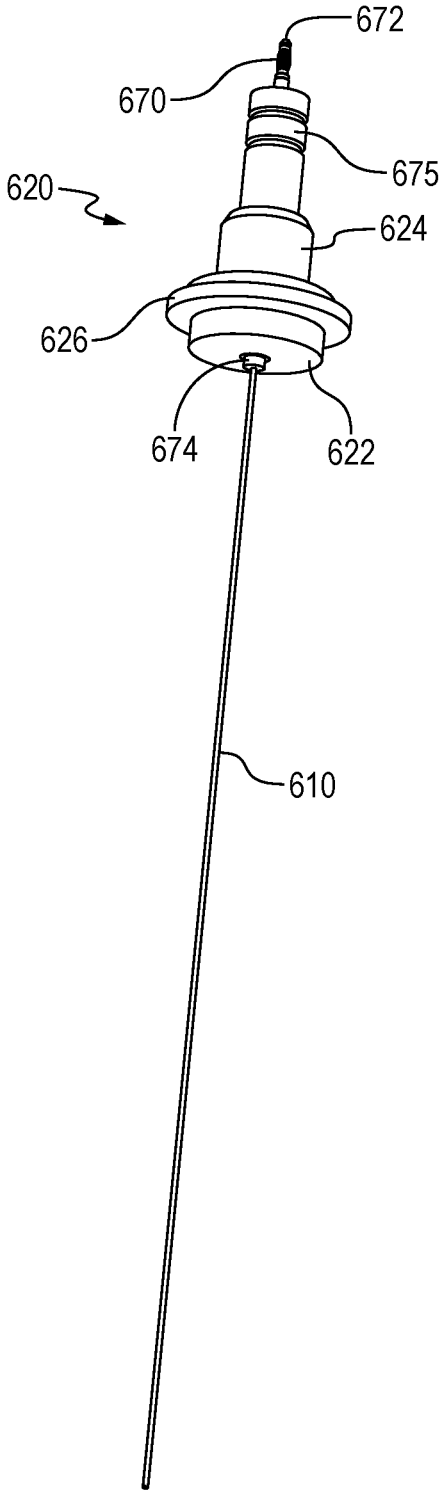
FIG. 21 is a perspective view of a top end plate. A contact pin and supporting bulkhead are seen extending up from the top plate. An electric line extends down. The view of FIG. 21 is the same as in FIG. 6A, but with the carrier tube and bottom end plate removed to show the electric line.

FIG. 21 is a perspective view of the top end plate 620. The contact pin 670 and supporting bulkhead 675 are seen extending up from the top plate 620. The electric line 610 is connected to the conductor pin 670 at end 674 and extends down. The view of FIG. 21 is the same as in FIG. 6A, but with the carrier tube 500 and bottom end plate 630 removed to show the electric line 610.

Figure 22A:
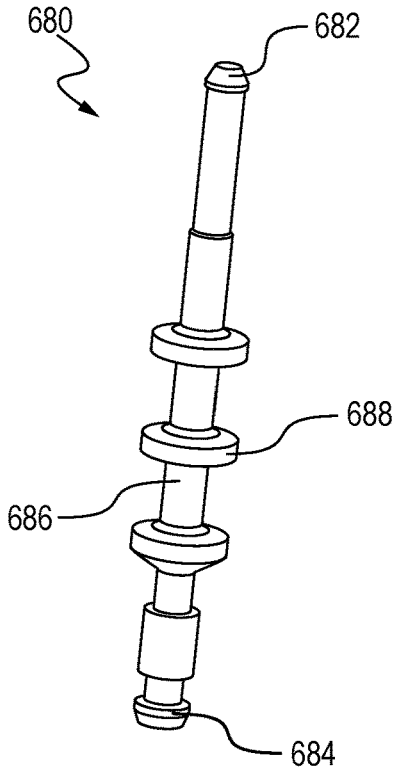
FIG. 22A is a perspective view of another contact pin from FIGS. 7A and 7B. In this case, the contact pin may be either a detonation pin used to transmit detonation signals to a detonator in a carrier tube, or a signal transmission pin used to transmit instruction signals to an addressable switch.

FIG. 22A is a perspective view of an illustrative pin 680. Note that pin 680 is illustrative of either of signal transmission pin 720' or detonation transmission pin 720" as it is the same pin design. The pin 680 is used to transmit signals through an end plate. For example, the detonator pin 720" transmits signals from the addressable switch 660 to a detonator in an adjacent carrier tube 500.

The illustrative transmission pin 680 has a proximal end 682 and a distal end 684. The proximal end defines a contact head 682 that resides within the switch housing 650. Intermediate the proximal end 682 and the distal end 684 is an elongated body, or shaft 686. The elongated shaft 686 is fabricated from an electrically conductive material, such as brass. The shaft 686 optionally includes a series of flanges 688 designed to strengthen the pin 680 within the bulkhead 685.

Figure 22B:
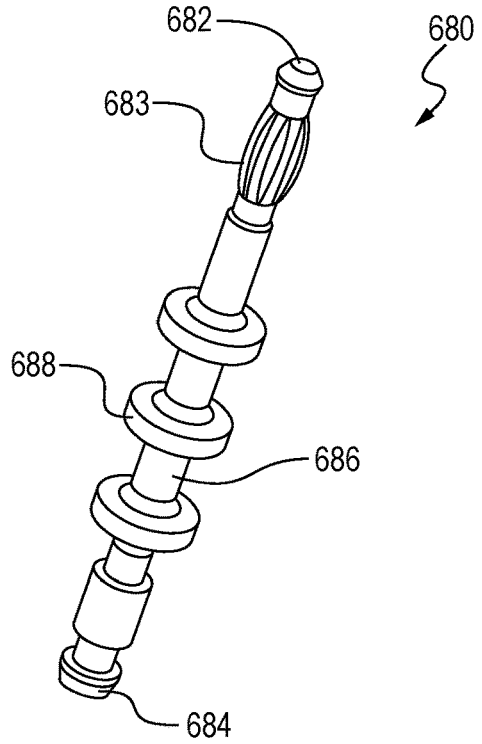
FIG. 22B is another perspective view of the pin of FIG. 22A. Here, a centralizer is shown at a proximal end of the pin.

FIG. 22B is another perspective view of the detonation pin 680 of FIG. 22A. Here, a centralizer 683 is shown at the proximal end 682 of the detonation pin 680. The centralizer 683 helps secure the detonation pin 680 within a contact clip 640.

Figure 23A:
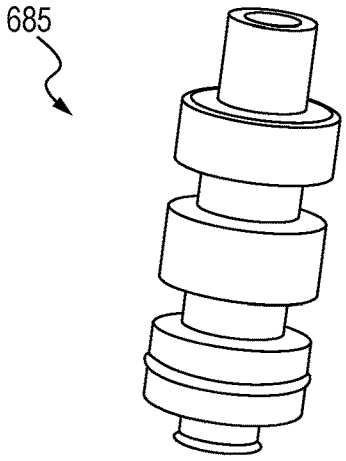
FIG. 23A is a perspective view of a mini-bulkhead. The mini-bulkhead is configured to frictionally encapsulate the pin of FIG. 22A.

FIG. 23A is a perspective view of a detonator bulkhead 685. The bulkhead 685 includes a bore that is configured to frictionally encapsulate the detonation pin 680 and its flanges 688 of FIGS. 22A and 22B.

Figure 23B:
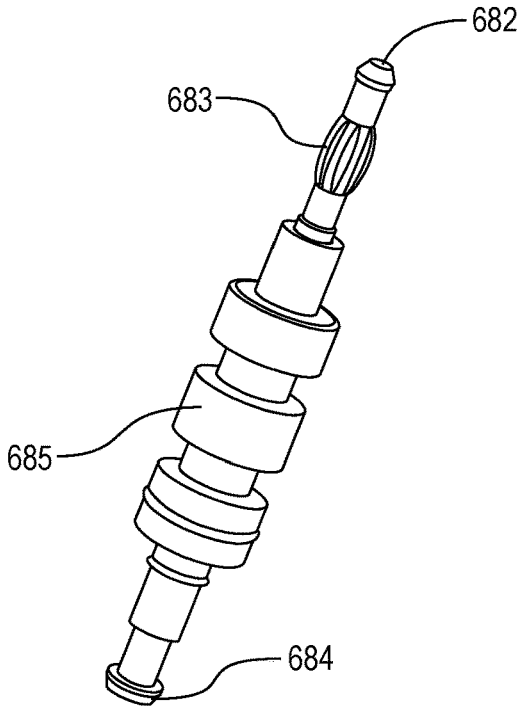
FIG. 23B is a perspective view of the bulkhead of FIG. 23A. Here, the bulkhead has received the contact pin of FIG. 22B.

FIG. 23B is a perspective view of the bulkhead 685 of FIG. 23A. Here, the bulkhead 685 has received the detonation pin 680 of FIG. 22B. The contact head 682 is seen extending up from the bulkhead 685 while the distal end of the detonation pin 680 is visible below the bulkhead 685.

Figure 24:
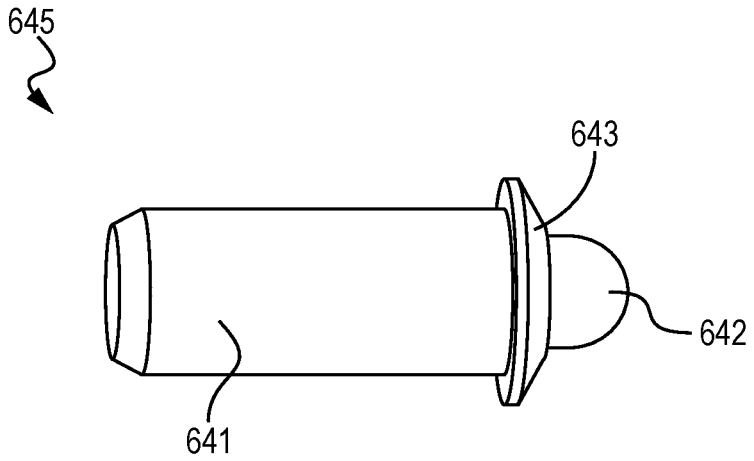
FIG. 24 is a side perspective view of a contact.

FIG. 24 is a perspective view of a contact 645. As seen in FIGS. 16 and 17, contacts 645 reside at the proximal end 652 of the switch housing 650. The contacts 645 serve as redundant grounds for the addressable switch 660. There are a total of three ground points.

Each contact 645 has a cylindrical body 641. The cylindrical body 641 is slid or crimped around a wiring terminal 640. Each contact 645 also had a contact tip 642. The contact tip 642 resides external to the switch housing 650. Finally, each contact 645 may have a flange 643. The flange 643 abuts a respective contact opening 658 external to the switch housing 650 in order to secure the contact 645 relative to the switch housing 650.

Figure 25A:
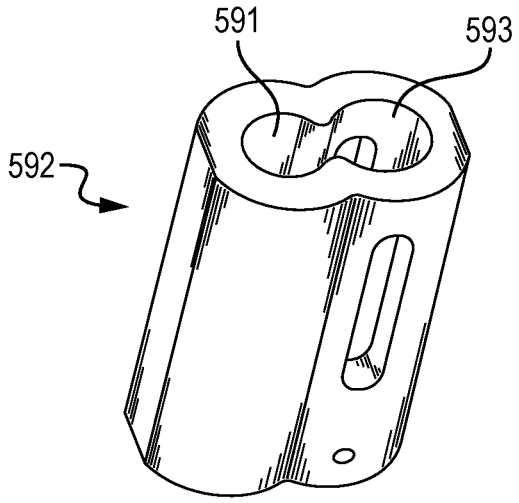
FIG. 25A is a perspective view of a detonator block as may be used in a gun barrel of a perforating gun assembly.

FIG. 25A is a perspective view of a detonator block 592 as may be used in a carrier tube 500 of a perforating gun assembly. The detonator block 592 is typically a plastic device having two cavities 591, 593. Cavity 591 receives a detonating cord (seen at 595 in FIG. 25C) while cavity 593 receives a detonator (seen at 594 in FIG. 25B). More specifically, the detonator block 592 mechanically connects the detonator 594 to an end of the detonating cord 595.

Figure 25B:
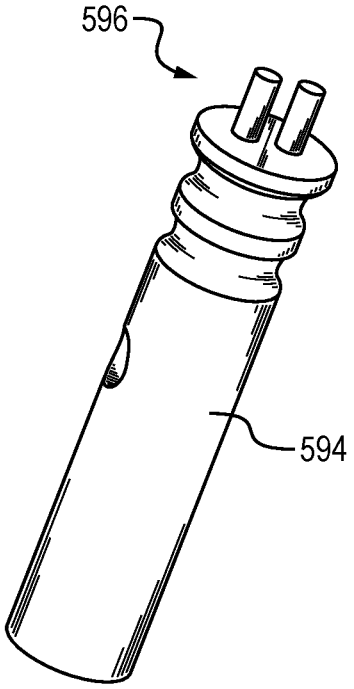
FIG. 25B is a perspective view of an illustrative detonator for a detonation assembly.

FIG. 25B is a perspective view of an illustrative detonator 594 for the detonator block 592 of FIG. 25A. Wires 596 are seen extending from the detonator 594. Two wires are shown, which may represent a power wire and a ground wire. However, it is understood that additional wires for power or for signaling may be provided. The wires 596 are in communication with the detonation pin 680.

Figure 25C:
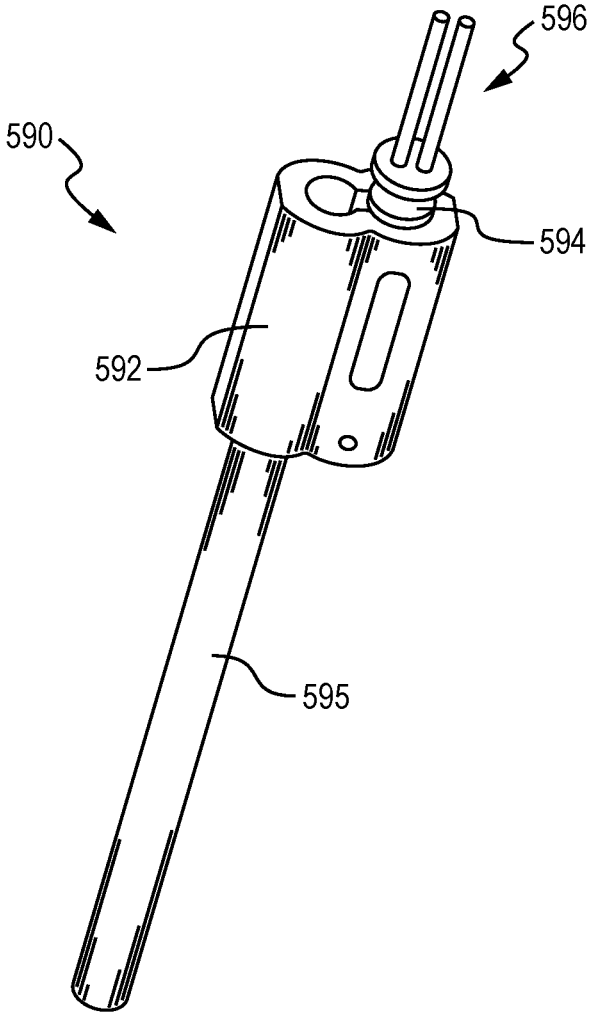
FIG. 25C is a perspective view of a detonation assembly. The detonation assembly includes the detonator block of FIG. 25A. The detonator block has received a detonator and a detonating cord. The detonator block places the detonator in proximity to an end of the detonating cord with its explosive material.

FIG. 25C is a perspective view of a detonation assembly 590. The detonation assembly 590 includes the detonator block 592 of FIG. 25A. Cavities 591 and 593 of the detonator block 592 have received the detonator 594 and the detonating cord 595, respectively. The detonator block 592 places the detonator 594 in proximity to the detonating cord 595 with its explosive material.

It is understood that in modern detonating systems, a variety of detonators and attachment methods for the det cord may be utilized in a similar fashion. The detonator block 592, detonator 594 and wire 596 shown herein are merely illustrative. In any arrangement, the detonation components 590 reside together in the carrier tube 500. Of interest, the detonating cord 595 is sheathed in a flexible outer case, typically plastic, and contains a high-explosive material. An example of an explosive material is the RDX compound. The detonating cord 595 is connected to charges 520 along the carrier tube 500 and delivers the ignition for detonation.

In operation, a detonation signal is sent from the surface 105 through the electric line 240. The signal reaches the perforating gun assembly 600. Typically, a lowest perforating gun is designated for first explosive initiation. In that case, the signal passes along an internal transmission wire 610 through each perforating gun 210 and is then passed along by the transmission pin 720', the addressable switches 660 in each tandem sub 400, and the contact pins 670 until the signal reaches the lowest tandem sub 400 and its addressable switch. The addressable switch then sends a detonation signal back up through the detonator pin 720", through wires 596, and to the detonator 594.

As another way of expressing the sequence, an IE signal enters the perforating gun assembly via a big bulkhead, passes down the carrier tube, goes through the transmission pin and into the addressable switch. If a detonation signal is present, it is sent back upstream through the detonator pin and into the detonator. Otherwise, it can continue downstream from the addressable switch to the next perforating gun. The process then repeats.

After production casing has been perforated at a first level, the operator may pull the perforating gun assembly 200 up the wellbore 100. The operator then sends a next detonation signal down through the electric line 240, through the signal line 610 of the perforating gun assembly 200 and the various tandem subs 400 and contact pins 670, and down to a next-lowest tandem sub 400. The detonation signal is recognized by the addressable switch 660 in the next-lowest tandem sub 400 and a detonation signal is sent through a detonator pin 720" and wires 596 to a next associated detonator 594. The detonation charge in the detonator 594 ignites the explosive material in the detonator cord 595 and the charges 520 of the next upstream gun barrel 212.

The pressure wave from the charges acts against the bottom end plate 630, protecting the tandem sub 400 and housed electronics from damage from the upstream perforating gun assembly 210.

A detonator assembly 590 is placed in the upstream gun barrel 310. The detonator assembly 590 includes the detonator block 592, the detonating cord 595 and the detonator 594 itself. At the same time, the electronic switch 660 resides within the tandem sub 400, and more particularly within a bore of the tandem sub 400.

It is understood that the relative arrangement of the gun barrel 212, the bottom end plate 630, the tandem sub 400, electronic switch housing 650 and all other components of the perforating gun assembly 600 may be "flipped." In this way, the tandem sub 400 is protected from a pressure wave upon detonation of charges in a downstream gun barrel 212.

As can be seen, a novel detonation system is provided. The detonation system provides protection for the electronics within the tandem sub during detonation of an upstream (or adjacent) perforating gun. In one embodiment, the detonation system first includes the novel tandem sub. The tandem sub defines a generally tubular body having a first end and a second end. The first end and the second end each comprise male connectors. This allows the tandem sub to be threadedly connected, in series, to respective perforating guns. Thus, the first end is threadedly connected to a first perforating gun (or, more precisely, a female threaded end of a gun barrel), while the second end is threadedly connected to a second perforating gun (or, again, a female threaded end of an opposing gun barrel).

The first end of the tandem sub abuts a first (or bottom) end plate. Similarly, the second opposing end of the tandem sub abuts a second (or top) end plate. These may be in accordance with the bottom 630 and top 620 end plates described above. An inner bore is formed between the first end and the second end of the tandem sub.

An electronic switch housing resides within the inner bore at the first end of the tandem sub. The switch housing holds an addressable switch configured to receive instruction signals from an operator at the surface.

In addition, a receptacle is formed within the inner bore of the tandem sub. The receptacle is dimensioned to closely receive a bulkhead. The bulkhead comprises:

a tubular body having a first end, a second end and a bore extending there between;

an electrical contact pin having a shaft extending through the bore of the bulkhead body and having a first end and a second end, wherein the shaft resides within the bore, and wherein the electrical contact pin transmits current from the first end to the second end; and a contact head located at the second end of the electrical contact pin outside of the bulkhead body and extending into the switch housing.

The electrical contact pin and its contact head are fabricated substantially from a conductive material such as brass.

The first end plate comprises a bore that defines a first opening and a second opening. A detonator pin extends through the first opening and into the carrier tube. The detonator pin is in electrical communication with a detonator residing within the first perforating gun. The detonator is configured to receive activation signals from the addressable switch, and ignite an explosive material within a detonating cord. The explosive material travels to shaped charges associated with the first perforating gun to ignite the charges. Thus, the tandem sub is an electrical feed-thru, pressure barrier that has been configured to allow room for a switch assembly.

All electrical connections for the detonation system may be made at the gun building facility, that is, except for the wires being connected to the detonator. The end plate on the gun barrel (or gun carrier) is removed, and the pre-wired electronic switch assembly (that is, the switch housing 650 and encapsulated switch 660) is installed. Beneficially, the pre-wired switch assembly can be tested at the gun building facility to reduce the chance of a mis-wired connection.

Note again that the tandem sub 400 need not have a side port. Removing the port from the sub 400 eliminates problems associated with known ports such as gun-flooding due to a missing o-ring and pinched wires under the plug port. The detonator is installed later in the field to comply with DOT and ATF regulations and API-RP67 recommendations.

Figure 26:
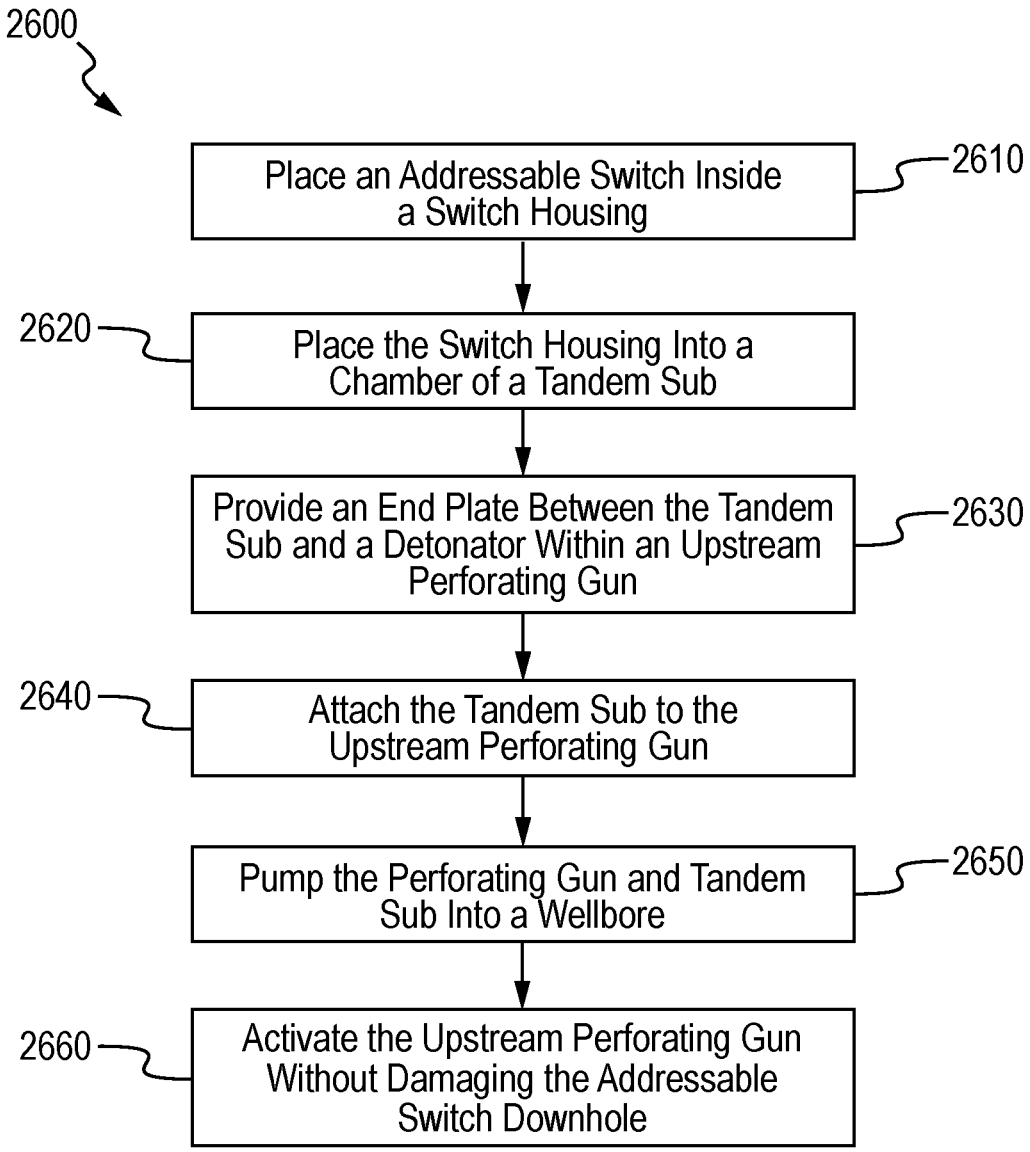
FIG. 26 presents a flow chart showing steps for a method of detonating explosive charges associated within a perforating gun, in one embodiment.

In addition to the detonation system discussed above, a method of detonating explosive charges associated with a perforating gun is presented herein. FIG. 26 is a flow chart showing steps for a method 2600 of detonating explosive charges associated with a perforating gun.

The method 2600 first comprises placing an addressable switch inside of an electronic switch housing. This is provided in Box 2610.

The method 2600 next includes placing the switch housing into a chamber of a tandem sub. This is shown at Box 2620. The addressable switch is configured to receive instruction signals from a surface, and if an activation signal for the tandem sub is recognized, to send a detonation signal on to the appropriate detonator.

The method 2600 also includes providing an end plate at a top end of the tandem sub. The end plate will reside between the tandem sub and an upstream perforating gun. This is shown at Box 2630. The end plate is preferably a bottom end plate as it resides at the bottom of an adjacent upstream perforating gun.

The method 2600 next optionally includes attaching the tandem sub to a downstream perforating gun. In this instance, the downstream perforating gun is attached to the tandem sub at an end opposite the upstream perforating gun. A perforating gun assembly is thus formed.

The method 2600 further comprises pumping the perforating guns and tandem sub into a wellbore. This is seen at Box 2650. Preferably, the perforating gun assembly is pumped into the horizontal portion of the wellbore for perforating a casing string.

The method 2600 then includes activating the upstream perforating gun without damaging the electronic switch assembly in the tandem sub. This is provided in Box 2660. Activating the upstream perforating gun means that charges associated with the upstream perforating gun are detonated in response to a detonation signal sent to a detonator within the upstream perforating gun.

In operation, the operator will send a control signal from the surface, down the e-line (such as e-line 240 of FIG. 2), and to the signal transmission pin 720'. The control signal defines an instruction signal that is specifically sent via the ground pin 710 and the signal transmission pin 720', and to the addressable switch 660. If the instruction signal is not recognized as a detonation signal for that tandem sub 400, the signal is sent on through the contact head 672 residing inside of the switch housing 650. From there, the signal is sent through the contact pin 670 and to a next perforating gun.

On the other hand, if the instruction signal is recognized by the addressable switch 660 as an activation signal, then the switch 660 is armed and a window of time is opened (typically about 30 seconds) in which to send a detonation signal from the surface. As part of the detonation signal, an instruction is sent telling the upstream perforating gun (or the detonator within the upstream perforating gun) to be activated.

A detonation signal is sent from the addressable switch 660 to the bulkhead 685. The detonation signal is specifically sent to the detonation pin 680, and then to the detonator 594. Of interest, the detonation pin 680 extends through the bottom end plate 630, and to the detonator 594.

The charges in the upstream perforating gun are detonated. Due to the presence of the end plate and the use of sealed pins 710,720', 720", the integrity of the switch assembly (that is, the switch housing 650 and encapsulated switch 660) in the tandem sub 400 is preserved and, thus, the switch assembly may be reused for another perforation operation. Similarly, the contact pin, the bulkhead, and the tandem sub itself are protected for later re-use.

Before the detonation of the upstream perforating gun, the electronic switch can feed current down to a next perforating gun (or to a bulkhead associated with a next perforating gun), depending on the instruction.

The disclosed embodiments provide methods and systems for preventing electronics located inside a switch sub from being damaged by detonation of an adjacent perforating gun. It should be understood that this description is not intended to limit the invention; on the contrary, the exemplary embodiments are intended to cover alternatives, modifications, and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

Further, variations of the detonation system and of methods for using the detonation system within a wellbore may fall within the spirit of the claims, below. It will be appreciated that the inventions are susceptible to other modifications, variations, and changes without departing from the spirit thereof.

We claim:

1. A detonation system for a perforating gun assembly, comprising:

a tandem sub defining a tubular body having a first end and a second opposing end, and an inner bore extending from the first end to the second end;

a perforating gun comprising a carrier tube, a detonator and a plurality of charges residing within the carrier tube, and a gun barrel;

a switch housing residing within the inner bore of the tandem sub proximate the first end;

an addressable switch residing within the switch housing and configured to receive instruction signals from a surface;

a bottom end plate residing between the carrier tube and the first end of the tandem sub, the bottom end plate having a first through-opening; and a detonator pin sealingly extending through the first through-opening, wherein the detonator pin has a proximal end that extends into the switch housing and is in electrical communication with the addressable switch, and a distal end that extends into the carrier tube and is in electrical communication with a detonator;

and wherein:

the detonator pin is configured to receive detonation signals from the addressable switch, and transmit them across the bottom end plate and to the detonator; and the bottom end plate provides a seal against the first end of the tandem sub to protect the addressable switch from a pressure wave generated by detonation of the plurality of charges in the carrier tube.

2. The detonation system of claim 1, further comprising:

a bulkhead residing around an intermediate portion of the detonator pin, wherein the bulkhead resides within the first through-opening to provide the seal;

and wherein the detonator pin is fabricated from an electrically conductive material, while the bulkhead for the detonator pin is fabricated from a non-conductive material.

3. The detonation system of claim 2, wherein the first end of the tandem sub is threadedly connected to female threads of the gun barrel.

4. The detonation system of claim 2, further comprising:

a contact pin comprising a contact head that extends into the switch housing, a shaft, and a distal end in electrical communication with a signal line extending from a surface, wherein the contact pin is configured to transmit instruction signals from a surface and the addressable switch, and to a downstream perforating gun by means of the signal line;

and wherein the contact pin is fabricated from an electrically conductive material.

5. The detonation system of claim 4, further comprising:

a receptacle within the tandem sub adjacent the switch housing;

a bulkhead residing within the receptacle, the bulkhead having an inner bore holding the contact pin; and a top end plate residing at the second end of the tandem sub;

and wherein:

the contact pin has a proximal end that extends into the top end plate, and a distal end that extends into the switch housing and is in electrical communication with the addressable switch; and the bulkhead for the contact pin is fabricated from a non-conductive material.

6. The detonation system of claim 5, further comprising:

a second through-opening in the bottom end plate;

a signal transmission pin having a shaft sealingly residing along the second through-opening, and the signal transmission pin comprising a proximal end extending into the switch housing and being in electrical communication with the addressable switch, and a distal end extending into the carrier tube and being in electrical communication with signals from the surface or an upstream perforating gun;

and wherein the addressable switch is configured to:

monitor instruction signals received through the signal line and sent via the signal transmission pin, and send a detonation signal through the detonator pin and to the detonator when an instruction signal is received to detonate charges in the carrier tube.

7. The detonation system of claim 6, further comprising:

a ground post having a shaft threaded into the bottom end plate, and comprising a proximal end extending into the bore of the tandem sub, with the ground post being in series with the signal line.

8. A detonation system for a perforating gun assembly, the perforating gun assembly having a carrier tube, a plurality of charges residing within the carrier tube, a gun barrel holding the carrier tube, and a signal line extending through the carrier tube, and the detonation system comprising:

a tandem sub defining a tubular body having a first end and a second opposing end;

an inner bore within the tandem sub extending from the first end to the second opposing end;

a switch housing residing within the inner bore of the tandem sub proximate the first end;

an addressable switch residing within the switch housing and configured to receive instruction signals from a surface;

a bottom end plate residing between the carrier tube and the first end of the tandem sub, the bottom end plate having first and second through-openings;

a detonator residing within the carrier tube;

a detonator pin extending through the first through-opening, wherein the detonator pin has a proximal end that extends into the switch housing and is in electrical communication with the addressable switch, and a distal end that extends into the carrier tube and is in electrical communication with the detonator;

a signal transmission pin extending through the second through-opening, wherein the signal transmission pin has a proximal end that also extends into the switch housing, and a distal end that extends into the carrier tube and i in electrical communication with signals from the surface or an upstream perforating gun; and a contact pin comprising a contact head that extends into the switch housing, a shaft, and a distal end in electrical communication with the signal line, wherein the contact pin is configured to transmit instruction signals from a surface and the addressable switch, and to a next perforating gun by means of the signal line;

and wherein:

the first end of the tandem sub is threadedly connected to female threads of the gun barrel; and the bottom end plate provides a seal against the first end of the tandem sub to protect the addressable switch from a pressure wave generated by detonation of the plurality of charges in the carrier tube.

9. The detonation system of claim 8, wherein:

the perforating gun assembly resides within a wellbore;

the signal line is in electrical communication with an e-line that extends from the perforating gun assembly up to the surface;

the detonator is configured to ignite an explosive material that travels through a detonating cord and to the plurality of charges residing within the carrier tube in response to a detonation signal sent by the addressable switch; and the addressable switch is configured to monitor instruction signals received through the signal line and the signal transmission pin, and send a detonation signal through the detonator pin and to the detonator when an instruction signal is received to detonate charges in the adjacent carrier tube.

10. The detonation system of claim 9, further comprising:

a first bulkhead residing within the first through-opening and encasing an intermediate portion of the detonator pin;

a second bulkhead residing within the second through-opening and encasing an intermediate portion of the signal transmission pin;

a receptacle within the tandem sub adjacent the switch housing; and a third bulkhead residing within the receptacle, the third bulkhead having an inner bore holding an intermediate portion of the contact pin.

11. The detonation system of claim 10, further comprising:

a top end plate residing at the second end of the tandem sub;

and wherein:

the contact pin has a proximal end that extends into the top end plate, and a distal end that extends into the switch housing and receives an output signal from the addressable switch to communicate with a downstream perforating gun; and each of the first bulkhead, the second bulkhead and the third bulkhead is fabricated from a non-conductive material.

12. The detonation system of claim 11, wherein the gun barrel is upstream of the tandem sub.

13. The detonation system of claim 11, wherein the gun barrel is downstream of the tandem sub.

14. A tandem sub for a perforating gun assembly, comprising:

a first end, a second opposite end, and an inner bore formed between the first end and the second end of the tandem sub;

a switch housing residing within an inner bore of the tandem sub proximate the first end;

an addressable switch residing within the switch housing and configured to receive instruction signals from an operator at the surface;

a detonator pin having a proximal end that extends into the switch housing and is in electrical communication with the addressable switch, and a distal end that extends into an adjacent carrier tube and is in electrical communication with a detonator within the carrier tube;

a signal transmission pin also having a proximal end that extends into the switch housing and is in electrical communication with the addressable switch, and a distal end that extends into the adjacent carrier tube and transmits signals from the surface to the addressable switch;

a receptacle within the inner bore of the tandem sub proximate the second end, the receptacle being dimensioned to closely receive a bulkhead, wherein the bulkhead comprises:

a tubular body having a first end, a second end and a bore extending there between;

an electrical contact pin having a shaft extending through the bore of the bulkhead body, wherein the shaft frictionally resides within the bore; and a contact head located at an end of the electrical contact pin outside of the bulkhead and extending back up into the switch housing.

15. The tandem sub of claim 14, wherein: a bottom end plate resides between the first end of the tandem sub and the gun barrel; and the end plate provides a seal against the first end of the tandem sub to protect the addressable switch from a pressure wave generated by detonation of charges in the gun barrel.

16. The tandem sub of claim 15, wherein the addressable switch is configured to receive an initiation signal from the signal line as transmitted to it through the signal transmission pin, and then sends the detonation signal to the detonator by means of the detonator pin.

17. The tandem sub of claim 16, wherein:

the first end of the tandem sub is threadedly connected to a gun barrel associated with a perforating gun;

the adjacent carrier tube resides within the gun barrel; and the first perforating gun is upstream of the tandem sub.

18. The tandem sub of claim 16, wherein:

the tandem sub does not include a side port.

19. A method of detonating explosive charges associated with a perforating gun, comprising:

providing a tandem sub having an upstream end and a downstream end, and an inner chamber between the upstream and downstream ends;

placing an addressable switch into the chamber of the tandem sub;

attaching a downstream perforating gun to the downstream end of the tandem sub;

providing a bottom end plate at the upstream end of the tandem sub;

attaching the tandem sub to an upstream perforating gun, wherein the bottom end plate resides between the upstream perforating gun and the tandem sub, and thereby forming a perforating gun assembly;

pumping the perforating gun assembly into a wellbore; and activating the upstream perforating gun without damaging the electronic switch assembly in the tandem sub;

wherein the bottom end plate comprises:

a detonator pin;

a first through-opening sealingly receiving the detonator pin;

a signal transmission pin; and a second through-opening sealingly receiving the signal transmission pin;

and wherein the end plate provides a seal against the first end of the tandem sub to protect the addressable switch from a pressure wave generated by a detonation of charges in the upstream perforating gun.

20. The method of claim 19, wherein:

the wellbore comprises a horizontal leg;

the perforating gun assembly is pumped into the horizontal leg; and the upstream perforating gun is activated within the horizontal leg to perforate casing at a desired depth.

21. The method of claim 20, wherein the tandem sub comprises:

a first end comprising a male connector, the first end being threadedly connected to the upstream perforating gun and abuts the bottom end plate;

a second opposing end also comprising a male connector and being threadedly connected to the downstream perforating gun;

and wherein:

the addressable switch is configured to monitor instruction signals received from an electric line at the surface, and send a detonation signal through the detonator pin to detonate charges in the upstream perforating gun; and activating the upstream perforating gun comprises sending a signal from the surface, down the electric line, into a signal line, through the signal transmission pin, to the addressable switch, back upstream through the detonator pin, and into the detonator.

22. The method of claim 21, wherein the tandem sub further comprises:

a switch housing residing within the inner bore of the tandem sub;

a receptacle also residing within the inner bore of the tandem sub, the receptacle being dimensioned to closely receive a bulkhead, wherein the bulkhead comprises:

a tubular body having a first end, a second end and a bore extending there between;

an electrical contact pin having a shaft extending through the bore of the bulkhead body, wherein the shaft frictionally resides within the bore; and a contact head located at an end of the electrical contact pin outside of the bulkhead body and extending into the switch housing.

23. The method of claim 21, wherein:

the detonator pin has a proximal end that extends into the switch housing and is in electrical communication with the addressable switch, and a distal end that extends into the upstream perforating gun and is in electrical communication with the detonator; and the signal transmission pin also has a proximal end that extends into the switch housing and is in electrical communication with the addressable switch, and a distal end that receives signals from the surface.

24. The method of claim 23, further comprising:

sending an initiation signal from a surface, down the signal line, and to the signal transmission pin;

further sending the initiation signal from the signal transmission pin in the bottom end plate and to the addressable switch;

recognizing that an associated perforating gun is to be activated, sending the detonation signal from the addressable switch and to the detonator pin; and further sending the detonation signal to the detonator to initiate a detonation of the charges.

* * * * *